US008893801B2

(12) United States Patent
Hales et al.

(10) Patent No.: US 8,893,801 B2
(45) Date of Patent: Nov. 25, 2014

(54) METHOD AND APPARATUS FOR PRESSURE-ACTUATED TOOL CONNECTION AND DISCONNECTION

(75) Inventors: John H Hales, Frisco, TX (US); Ed A Eaton, Grapevine, TX (US); John D. Burleson, Carrollton, TX (US); John P Rodgers, Roanoke, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 101 days.

(21) Appl. No.: 13/810,857

(22) PCT Filed: Apr. 2, 2012

(86) PCT No.: PCT/US2012/031834

§ 371 (c)(1), (2), (4) Date: Jan. 17, 2013

(87) PCT Pub. No.: WO2013/151527

PCT Pub. Date: Oct. 10, 2013

(65) Prior Publication Data

US 2014/0202710 A1 Jul. 24, 2014

(51) Int. Cl.

| | |
|---|---|
| ***E21B 17/02*** | (2006.01) |
| ***E21B 19/16*** | (2006.01) |
| ***E21B 17/06*** | (2006.01) |

(52) U.S. Cl.

CPC ..... *E21B 19/16* (2013.01); *E21B 17/06* (2013.01)

USPC ..... 166/338; 166/340; 166/365; 166/377

(58) Field of Classification Search

CPC ..... E21B 17/021; E21B 17/04; E21B 19/16

USPC ..... 166/338–340, 360, 365, 377, 85.1

See application file for complete search history.

(56) References Cited

U.S. PATENT DOCUMENTS

| | | | | |
|---|---|---|---|---|
| 4,116,272 | A * | 9/1978 | Barrington | 166/340 |
| 4,577,687 | A * | 3/1986 | Lanmon, II | 166/243 |
| 4,915,178 | A * | 4/1990 | Goldschild | 166/385 |
| 5,398,760 | A * | 3/1995 | George et al. | 166/297 |
| 5,653,418 | A | 8/1997 | Olson | |
| 5,735,502 | A | 4/1998 | Levett et al. | |
| 5,778,979 | A * | 7/1998 | Burleson et al. | 166/297 |

(Continued)

OTHER PUBLICATIONS

PCT International Search Report for International Application No. PCT/US2012/031834 mailed Nov. 29, 2012.

*Primary Examiner* — Matthew Buck

(74) *Attorney, Agent, or Firm* — Anthony Iannitelli; Booth Albanesi Schroeder, LLC

(57) ABSTRACT

A method is presented for connecting and disconnecting sections of a work string for use in a subterranean wellbore. A preferred method of disconnecting includes the steps of positioning a stinger and a downhole tool assembly of a work string adjacent upper and lower sealing rams, such as in a BOP and lubricator assembly. The sealing rams are closed, defining a first and second pressure zone adjacent the tool. A differential pressure is applied across the pressure zones, moving a piston element in the tool assembly. Axial movement of the piston element causes relative rotational movement of cooperating locking elements. In one embodiment, the locking elements are rotated to an unlocked position and then move relative to one another axially in response to a biasing spring. The relative axial movement of the locking elements results in unlatching of a latching assembly, thereby disconnecting the tool and stinger.

20 Claims, 18 Drawing Sheets

(56) References Cited

U.S. PATENT DOCUMENTS

| | | | | | |
|---|---|---|---|---|---|
| 5,823,266 | A * | 10/1998 | Burleson et al. | ..... | 166/380 |
| 5,957,209 | A * | 9/1999 | Burleson et al. | ..... | 166/380 |
| 5,992,523 | A * | 11/1999 | Burleson et al. | ..... | 166/297 |
| 6,209,652 | B1 * | 4/2001 | Portman et al. | ..... | 166/379 |
| 6,719,061 | B2 * | 4/2004 | Muller et al. | ..... | 166/373 |
| 8,042,617 | B2 * | 10/2011 | Bowles et al. | ..... | 166/385 |
| 2006/0113083 | A1 * | 6/2006 | Connell et al. | ..... | 166/377 |
| 2006/0278406 | A1 | 12/2006 | Judge et al. | | |

* cited by examiner

METHOD AND APPARATUS FOR PRESSURE-ACTUATED TOOL CONNECTION AND DISCONNECTION

CROSS-REFERENCE TO RELATED APPLICATIONS

None.

FIELD OF INVENTION

This invention relates, in general, to an apparatus and method for connecting and disconnecting downhole tools from a work string, and more particularly, to connecting and disconnecting tools from a workstring in a BOP assembly by applying a differential pressure across two isolated pressure zones created by the BOP sealing rams.

BACKGROUND OF INVENTION

Without limiting the scope of the present invention, its background will be described with reference to perforating a hydrocarbon bearing subterranean formation with a shaped-charge perforating apparatus, as an example.

After drilling the section of a subterranean wellbore that traverses a hydrocarbon bearing subterranean formation, individual lengths of metal tubulars, often referred to as tubing sections, are typically secured together to form a work string that is then run-into and pulled out of the wellbore. One such work string is used for perforating a target zone. Typically, these perforations are created by detonating a series of shaped-charges located within one or more perforating gun tools deployed within the casing to a position adjacent to the desired formation. Connecting and disconnecting such downhole tools requires manipulation of the tools. Sometimes, conventional connections fail, either downhole or in a lubricator/BOP assembly during disconnecting procedures resulting in the lower end of the string falling into the wellbore.

Consequently, a need has arisen for a method and apparatus for secure latching, locking and unlocking upper and lower tool assemblies.

SUMMARY OF THE INVENTION

A method and apparatus are presented for connecting and disconnecting tubular sections of a work string, the work string for use in a subterranean wellbore extending through a hydrocarbon bearing zone. A preferred method of disconnecting includes the steps of positioning a work string adjacent two sealing assemblies, such as sealing rams in a BOP assembly. A stinger of a lower tool assembly is positioned adjacent the lower rams and a downhole tool assembly is positioned adjacent the lower sealing rams. The rams, when actuated, seal wellbore pressure below the lower ram and, further, define a first pressure zone between the rams and a second pressure zone above the upper rams. A differential pressure is applied across the pressure zones, moving a piston element in the tool assembly. Alternating pressure differential can be applied to reciprocate the piston element. Axial movement of the piston element causes relative rotational movement of two cooperating locking elements. The locking elements are rotated to an unlocked position, allowing the locking members to move axially relative to one another. The relative axial movement of the locking elements can be responsive to a biasing spring. In a preferred embodiment, the relative axial movement of the locking elements results in unlatching of a latching assembly at the lower end of the tool, thereby disconnecting the tool and stinger.

Exemplary mating members on the locking elements include corresponding, longitudinally extending teeth and notches, where relative axial movement of the locking elements is allowed when the teeth and notches align. The mating members can also have cooperating threads, where rotational movement of the mating members disengages the cooperating threads to unlock the locking elements.

In a preferred embodiment, a follower, such as a follower pin, extends from a locking sleeve into a surface groove on the exterior of the piston element. As the piston moves, the pin follows along the groove, thereby forcing rotation of the sleeve. Multiple strokes or cycles of the piston element can be used to incrementally rotate a locking element.

A method and apparatus for connecting the downhole tool assembly and a stinger is also presented. Once the upper tool is in position above the stinger, weight-down shears pins allowing an axially movable locking element, such as a sleeve, to translate upward into position adjacent an upper locking element. The locking members are moved either axially or rotationally with respect to each other into a locked position. In a preferred embodiment, a translational assembly is provided such that axial movement of a piston element is translated into rotational movement of one of the locking elements. Locking can be accomplished with mating members such as cooperating threads, flexure members, ratchet members, etc. In a preferred embodiment, rotational movement of the locking elements is accomplished by application of a differential pressure across the first and second pressure zones.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
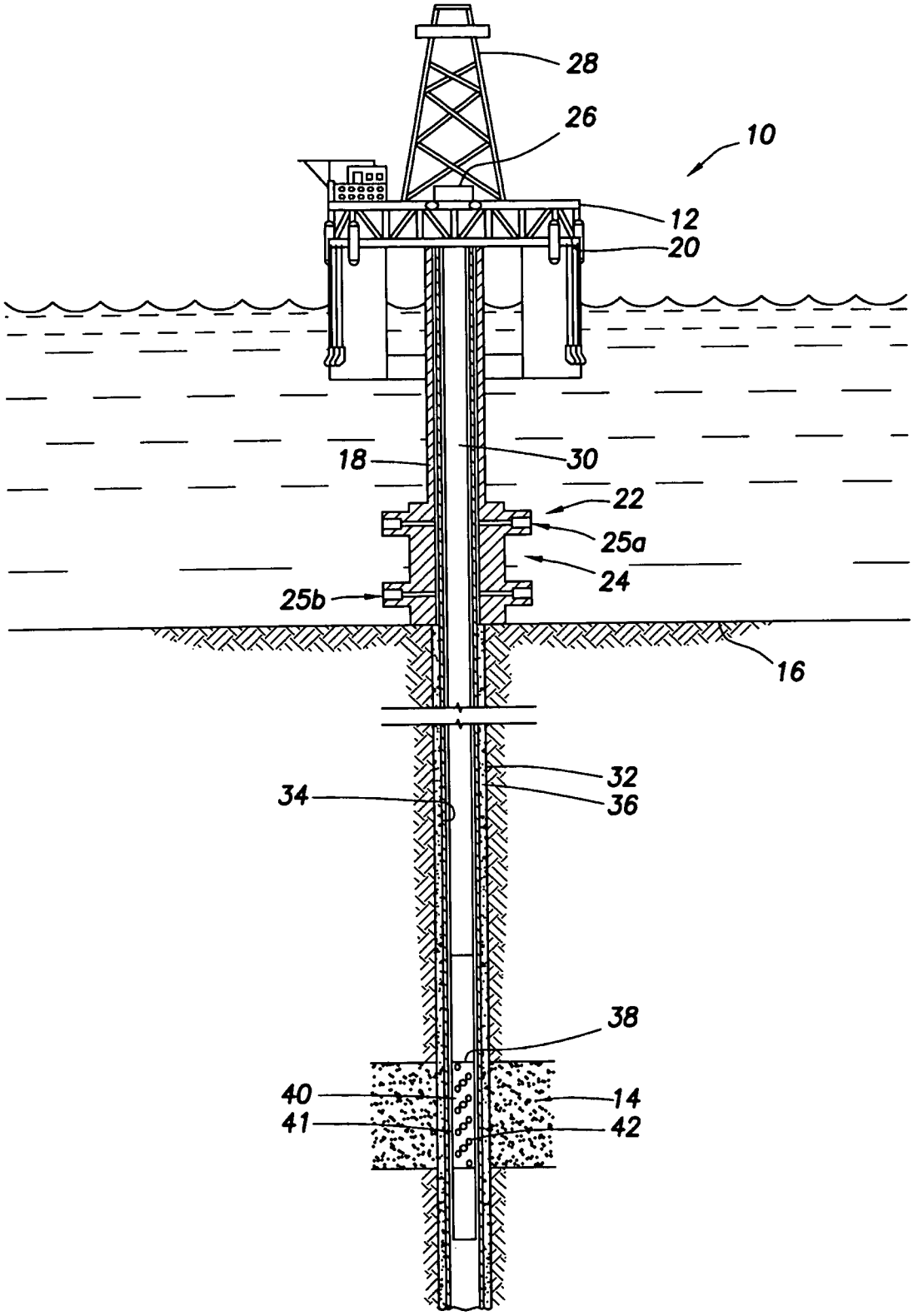
FIG. 1 is a schematic of a work string having a perforating apparatus operating from an offshore oil and gas platform, such as used in accordance with a method of the invention.

FIG. 1 is a schematic of a perforating apparatus operating from an offshore oil and gas platform and generally designated 10. A semi-submersible platform 12 is centered over a submerged oil and gas formation 14 located below sea floor 16. A subsea conduit 18 extends from deck 20 of platform 12 to wellhead installation 22 including blowout preventer 24 (BOP). The BOP includes multiple sealing ram assemblies 25*a*, 25*b*, for example. Platform 12 has a hoisting apparatus 26 and a derrick 28 for raising and lowering pipe strings, such as work string 30, lubricator assemblies, etc.

A wellbore 32 extends through the various earth strata including formation 14. A casing 34 is cemented within wellbore 32 by cement 36. Gun string 30 includes various tools including shaped-charge perforating apparatus 38 that is operable to enhance perforating performance in high pressure and high temperature wellbores. When it is desired to perforate formation 14, gun string 30 is lowered through casing 34 until shaped-charge perforating apparatus 38 is positioned adjacent to formation 14. Thereafter, shaped-charge perforating apparatus 38 is "fired" by detonating the shaped-charges that are disposed within the exterior tubular 40 of the shaped-charge perforating apparatus 38. If preferred, aligned recesses or scallops 42 are formed in the outer surface 41 of the exterior tubular 40. Upon detonation, the liners of the shaped-charges form jets that pass through the exterior tubular and form a spaced series of perforations extending outwardly through casing 34, cement 36 and into formation 14.

Even though FIG. 1 depicts a vertical well, it should be understood by those skilled in the art that the shaped-charge perforating apparatus of the present invention is equally well-suited for use in wells having other configurations including deviated wells, inclined wells, horizontal wells, multilateral wells and the like. Also, even though FIG. 1 depicts an offshore operation, it should be understood by those skilled in the art that the shaped-charge perforating apparatus of the present invention is equally well-suited for use in onshore operations. The details of operation of the surface equipment, conduit, reel assemblies, hydraulic lines, gauges, hydraulic pumps and bleed offs, kill and choke lines, etc., will not be described in detail herein. Additional information can be found in U.S. Pat. No. 7,487,836 to Boyce, U.S. Pat. No. 3,556,209 to Reistle, U.S. Patent Application No. 2003/0178200 A1, each of which is incorporated herein by reference for all purposes.

Figure 2:
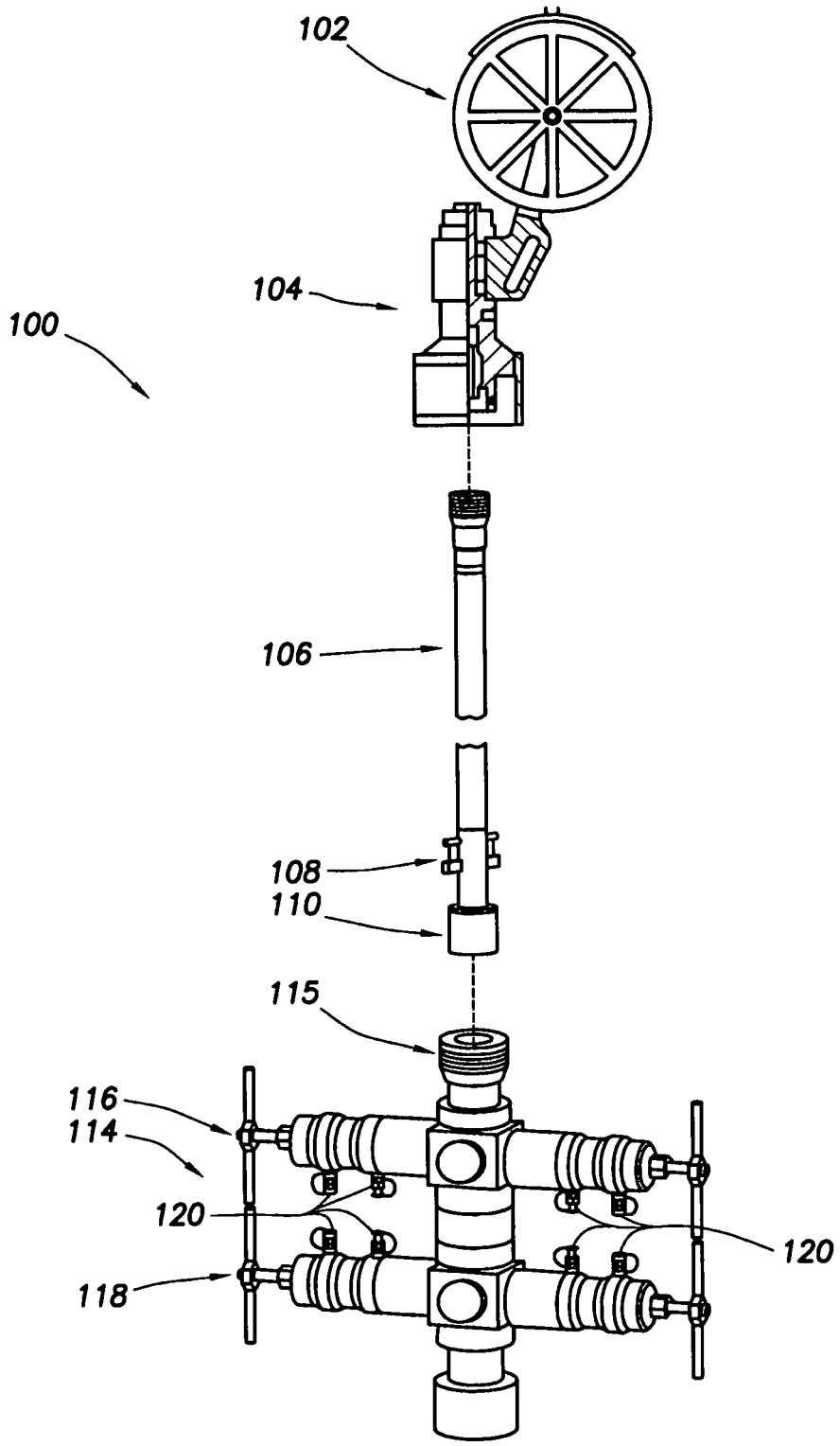
FIG. 2 shows an elevational, exploded view, in partial cross-section, of an exemplary above-surface wireline system for connecting tools in the BOP assembly, such as used in accordance with a method of the invention.

FIG. 2 shows an elevational exploded view, in partial cross-section, of an exemplary above surface wireline system 100 having a sheave assembly 102 (manual or hydraulic), stuffing box 104, lubricator, lubricator riser or lubricator riser assembly 106 having a pressure port assembly 108 with bleed-off and/or pump-in ports, and a connector 110 for connecting to the BOP assembly 114 at connector 115. The pressure ports will not be described herein in detail as they are common in the industry, as is their method of use. The BOP 114 is shown having an upper and a lower sealing ram 116 and 118. The rams are shown as hydraulic rams having hydraulic input and output ports 120. Alternately, manual rams can be used. Further, the BOP stack may take different configurations and include additional features, such as shear rams, blank rams, locator rams, etc.

As used herein, the term "ram" or "sealing ram" is used to mean a sealing assembly capable of sealing pressure above and below in annular areas around a tool string, tubular, tubing section, etc. The term "ram" is used generically and includes blank rams, pipe rams, pipe holders (which seal), blind rams, slip rams, etc. Sealing rams, BOP stacks, and lubricators are commercially available and will not be described in detail.

Figure 3:
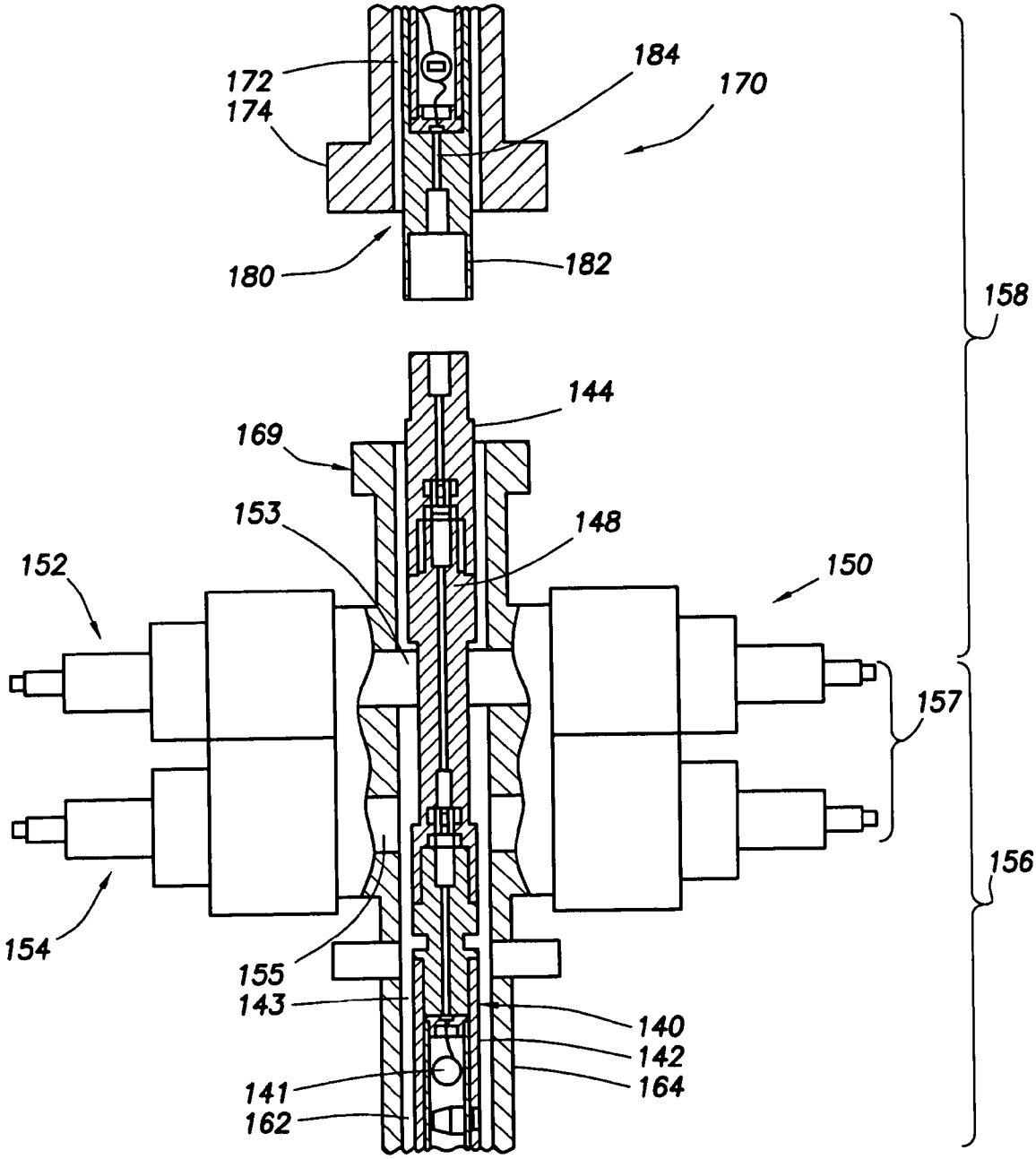
FIG. 3 is an elevational view in partial cross-section showing a BOP stack and lubricator assembly with an upper and a lower downhole tool assembly for connection.

FIG. 3 is an elevational view in partial cross-section showing a BOP stack and lubricator assembly with an upper and a lower downhole tool assembly for connection. A lower downhole tool assembly 140, such as a gun assembly with shaped-charges 141 and detonation cord. 143 shown, has a tool subassembly 142 and an upper connector subassembly 144. The connector subassembly 144 can be a threaded connector assembly, as shown, for threadedly connecting to an upper tool assembly 180, or can be a stinger, quick connect or other known connector. The lower tool assembly 140 also can include an isolator subassembly 148 and other subassemblies as are known in the art.

The lower tool assembly 140 is positioned in a BOP stack 150 having an upper and a lower sealing ram 152 and 154, a BOP connector 169, and other associated devices for operating and assembling a BOP stack. The upper sealing ram 152 is shown in a closed position, with ram elements 153 extended and contacting the exterior of the lower tool assembly. The rams are shown supporting the lower tool assembly (and any further tools attached below). The sealing ram seals against pressure and creates two isolated pressure zones, a wellbore pressure zone 156 below the upper ram 154 and having the pressure present in the wellbore 162, shown with casing 164. An upper pressure zone 158 is defined above the upper ram 154, in the annulus between the lower tool assembly and the BOP. The upper pressure zone can extend into an attached lubricator assembly 170. If the lower sealing ram 154 with ram elements 155 is also closed, the wellbore pressure zone 156 extends from below the lower ram elements 155 into the wellbore. In such a case, two isolated pressure zones are defined, a first between the upper and lower sealing rams 152 and 154, and a second above the upper sealing ram 152. The wellbore pressure can range from atmospheric to 20 kpsi or greater. The operational pressure in the lubricator is typically in the range of atmospheric to 10 kpsi. The pressure in the upper pressure zone can be selected by bleeding off or pumping in pressure, such as through a port of the lubricator assembly 170 or through pressure ports in the BOP stack.

Where there are different pressures in isolated pressure zones, a differential pressure exists across the zones. The differential pressure can be applied by reducing (bleeding off) pressure in a zone, by increasing or applying (pumping in) pressure in a zone, or a combination of these. The pressure changes are accomplished through pressure ports in the lubricator assembly and BOP assembly and attached pressure lines, as is known in the art. The pressures can also be equalized, such as prior to opening a ram, as is known in the art. The gauges, pressure lines, fluids, pumps, etc., for applying and bleeding pressure will not be described in detail herein as they are known in the art.

The lubricator assembly 170 is for transporting an upper tool assembly 180 during connection and disconnection of tools in a work string, for example. An annular space 172 is defined between the lubricator assembly and the tool assembly. The pressure in this annulus can be controlled via a pressure port, such as in FIG. 2, in the lubricator assembly. The lubricator assembly, and supported upper tool assembly, is lowered to the BOP. The lubricator assembly includes a connector 174 for attaching to the lubricator assembly to the BOP connector 169. Operation of the connectors is known in the art. Use of a lubricator assembly is also known in the art and will not be described here.

The upper tool assembly 180 includes a connector assembly 182 for connecting to the connector subassembly 144 of the lower tool. The connector assemblies cooperate to latch or otherwise connect the tools, such as by threaded attachment, latch, stinger and collet or skirt, etc. The upper tool assembly can include subassemblies as known in the art. The upper tool assembly, is shown as a perforating gun assembly with detonation cord 184 visible.

Figure 4:
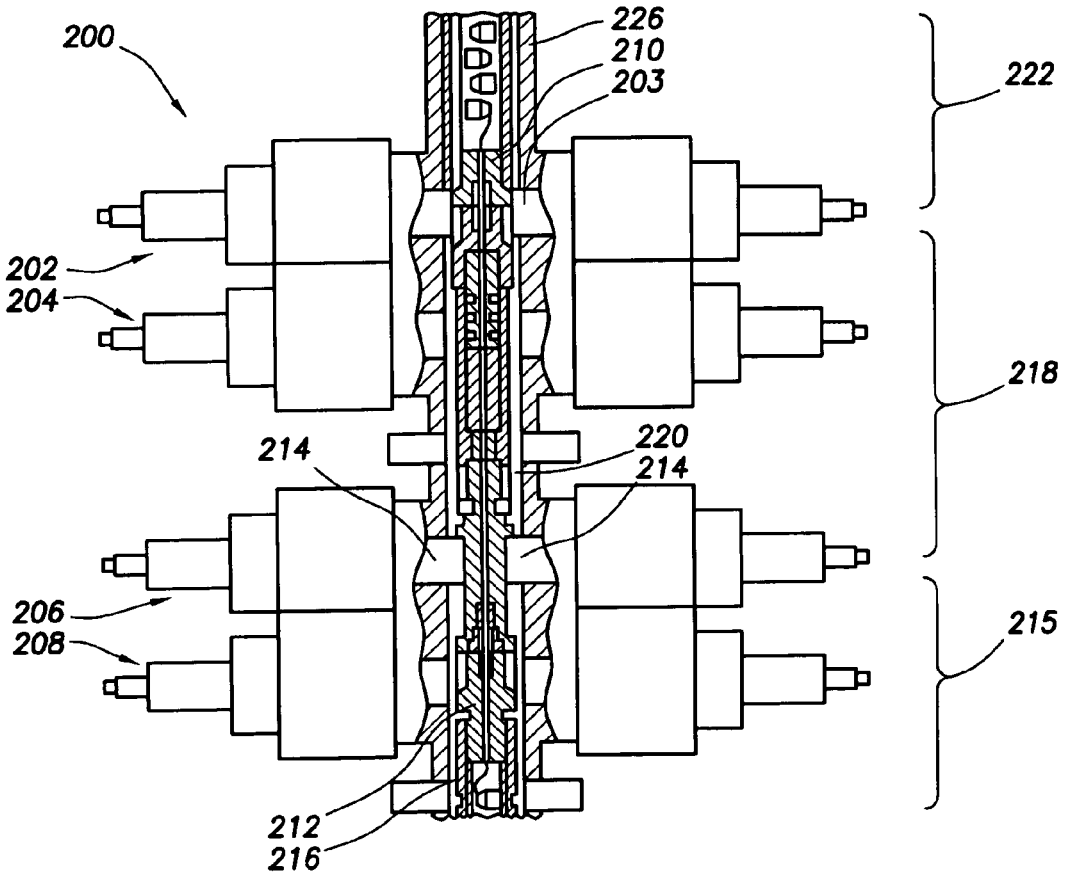
FIG. 4 is a schematic elevational view of an exemplary BOP used for connecting and disconnecting according to a method of the invention.

FIG. 4 is a schematic elevational view of an exemplary BOP used for connecting and disconnecting according to a method of the invention. The apparatus and methods described herein can also be performed using a BOP stack having multiple ram assemblies. An exemplary BOP stack 200 includes four ram assemblies. A slip or seal ram 202 is positioned above a blank ram assembly 204, a seal or slip ram assembly 206 and a bottom shear ram assembly 208. An upper tool assembly 210 is seen connected to a lower tool assembly 212. The lower tool assembly is supported by the ram elements 214 of the sealing ram 206 which seals the wellhead pressure below the ram elements. A wellbore pressure zone 215 is defined then, in the BOP annulus 216 between the lower tool assembly and the BOP interior surface, and below the ram elements into the wellbore below. The wellbore pressure may also be present within the lower tool assembly if the assembly is pressure balanced or otherwise open to the wellbore pressure. A plug or valve in the lower tool assembly or elsewhere in the string prevents wellbore pressure from being transmitted upward through the interior passageways of the lower tool assembly.

The upper sealing ram 202 is seen closed, with ram elements 203 closed about the upper tool assembly 210, thereby defining a first pressure zone 218 between the upper sealing ram elements and in the BOP annulus 220 between those ram elements. Similarly, a second pressure zone 222 is defined above the upper ram elements 203 in the annulus 224 of riser or conduit 226. Pressure in the first and second pressure zones can be controlled by bleed-off and pressure-up ports communicating with the annulus 220 and annulus 226, according to methods and apparatus known in the art for controlling pressure in and above a BOP stack.

Figure 5A:
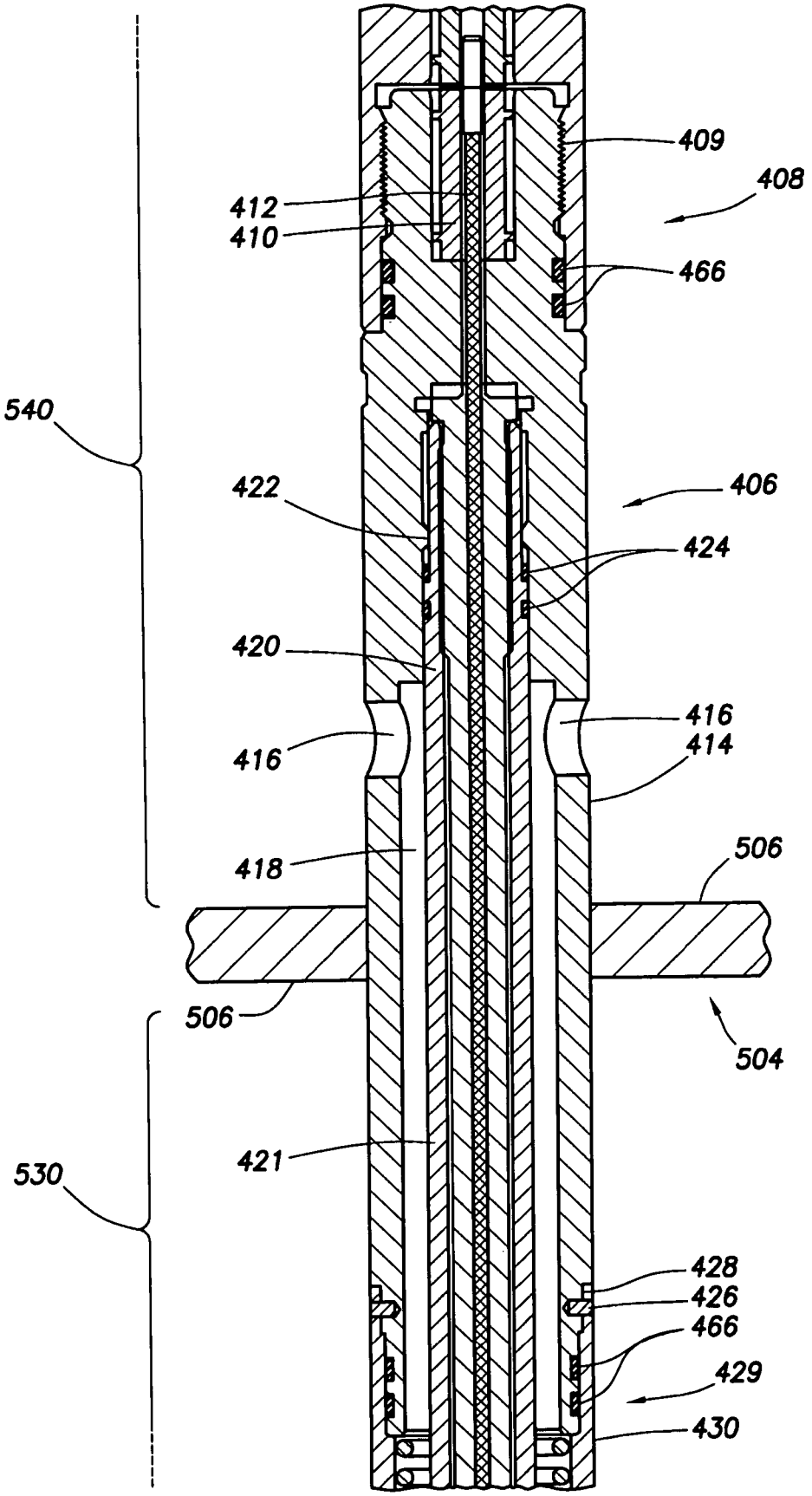
FIGS. 5A-C are schematic elevational views of a preferred embodiment of the invention showing an adjacent upper and lower tool assemblies positioned for connection.
Figure 5B:
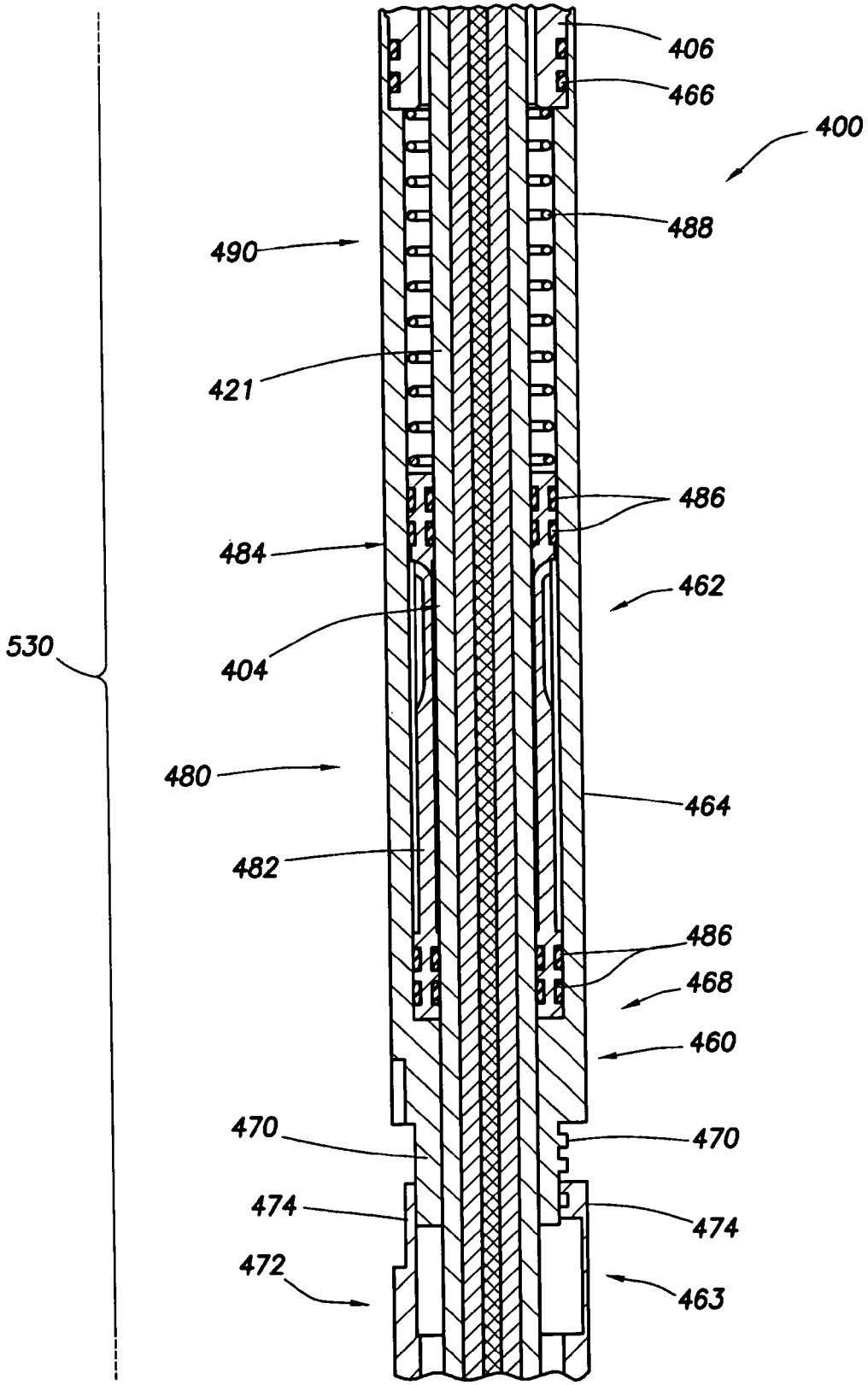
Figure 5C:
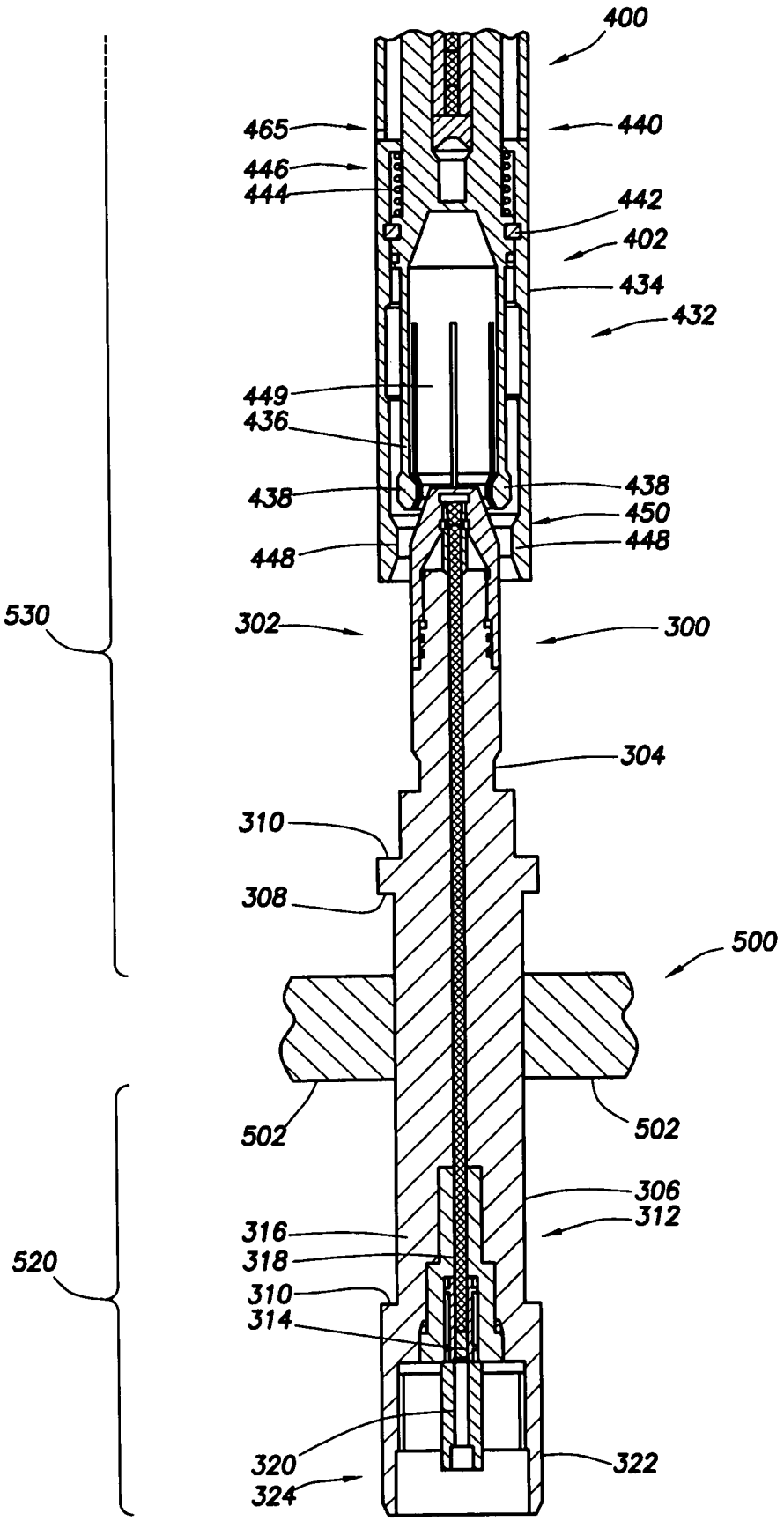
Figure 6A:
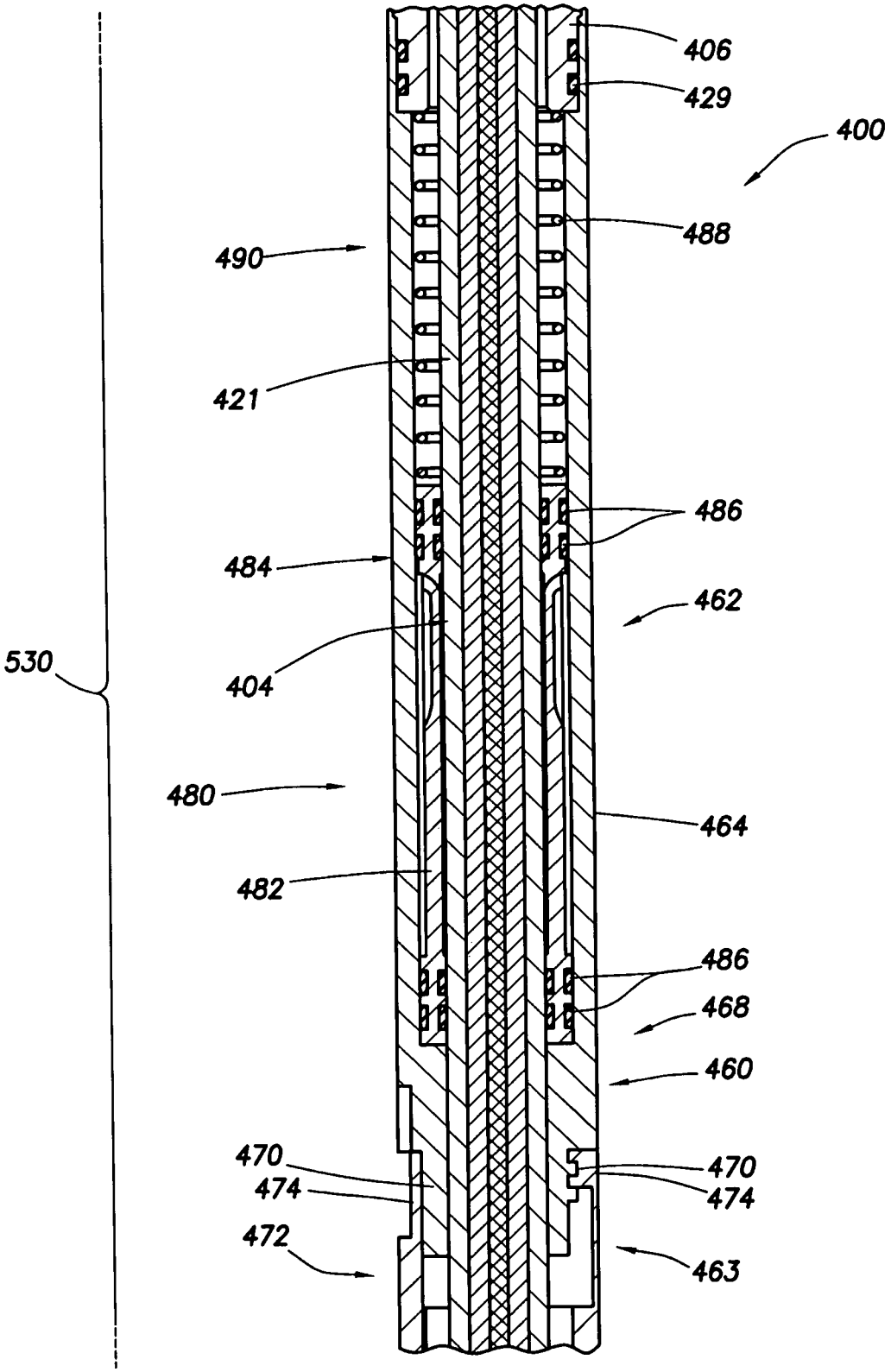
FIGS. 6A-B are schematic views of the assembly shown in FIG. 5 with the upper and lower tool assemblies in a latched and locking position.
Figure 6B:
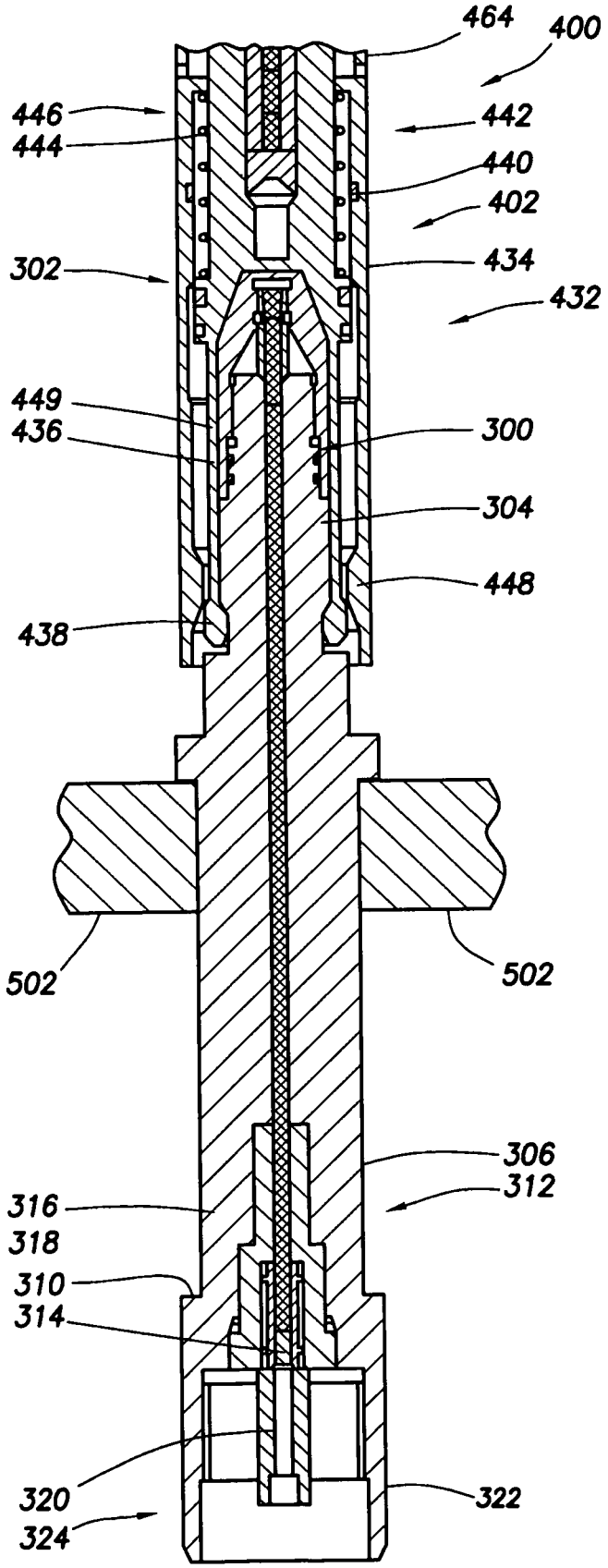

FIG. 5A-C is a schematic elevational view of a preferred embodiment of the invention having an upper and lower tool assembly adjacent one another and ready for connection with the upper tool in a run-in position. FIG. 6A-B is a schematic elevational view of the assembly shown in FIG. 5 with the upper and lower tool assemblies in a latched position.

FIG. 5A-C shows an upper tool assembly with a lower connector subassembly for connection to a lower tool assembly. The upper tool assembly includes a releasable locking assembly. Partial upper and lower sealing ram elements are indicated in cross-section. The tool assemblies are seen disconnected prior to connection. Lower tool assembly 300 includes a connector assembly 302 at its upper end. The connector assembly is shown as a stinger for cooperation with a collet assembly of the upper tool assembly, as explained elsewhere herein. The connector assembly 302 includes a collet trap 304 for cooperating with a collet assembly 432 on the upper tool assembly 400. The lower tool also includes a seal area 306 preferably delimited by shoulders 308 and 310. The seal area 306 defines a sealing surface for engagement by the sealing elements 502 of the lower sealing ram assembly 500. The lower tool assembly 300 can include other subassemblies, such as a tool subassembly 312, as shown. Here, subassembly 312 is a detonation sub for connecting to a perforating gun assembly below (not shown). The detonation sub has a detonation cord 314, a cylindrical housing 316, a passageway 318 through the sub, and a detonation connection 320 in a tool connector 322 for connection to a lower tool assembly. The lower tool can include various other subassemblies, assembly parts, etc., as is known in the art.

The lower tool assembly 300 is positioned adjacent a lower sealing ram assembly 500, shown in a closed position with sealing elements 502 contacting sealing surface 306 and supporting the lower tool assembly. With the rams closed, a wellhead pressure zone. 520 is created or defined below the ram elements 502. Where the lower tool assembly defines a fluid passageway therethrough, a plug or valve member 324 can selectively plug the passageway to isolate wellhead pressure below the lower sealing ram.

The upper tool assembly 400 includes a lower connector subassembly 402, a tool subassembly 404, and sealing subassembly 406 and an upper connector subassembly 408. The upper connector subassembly 408 is configured to connect to a cooperating connector on a tool or string section above the upper tool, or to a wireline or a coiled tubing. The connector sub can take any form known in the art, such as a threaded or latch connector, and will not be described in detail.

The sealing sub 406 is attached to the upper connector subassembly 408 at attachment 409. When assembled, the upper connector sub and sealing sub define a detonation cord passageway 410 through which runs a detonation cord 412. The sealing sub also has a sealing surface 414 defined on its exterior surface. An upper sealing ram assembly 504 is shown with sealing elements 506 engaged. The engagement of both the upper and lower ram assemblies defines two pressure zones, a first pressure zone 530 between the upper and lower ram elements, and a second pressure zone 540 defined above the upper ram elements.

The upper end of the sealing sub 406 includes one or more pressure ports 416 which provide fluid communication between the second pressure zone 540 and an interior passageway 418. The sealing sub can also house all or a portion of the tool subassembly 404, here a portion of a perforating gun sub having a gun housing 420 attached to the sealing sub at 422 and isolated from the passageway by seals 424. Extending radially from the sealing sub is a rotational joint member, namely a rotation limiter 426, shown as a pin which cooperates with a corresponding rotational slot 428 or groove of upper locking element or sleeve 462.

The tool subassembly 404 is shown as a perforating gun subassembly 420 having a tubular or body throughout 421. The perforating gun subassembly will not be described in further detail. Perforating gun assemblies are available commercially from Halliburton. Alternately, other tool subassemblies can be used in conjunction with the inventions described herein.

In a preferred embodiment, the upper tool assembly 400 also includes a lower connector subassembly 402. The lower connector subassembly preferably has a collet assembly 432 for cooperating with the collet trap 304 and stinger 302. The collet assembly 432 includes a collet housing 434, collet arms 436 having upsets or dogs 438, a shear pin assembly 440 having one or more shear pins 442, a biasing spring 444 in a spring housing 446, and a collet body 449 having a retainer ring 450, shown annular upsets or dogs 448 on the interior surface of the retainer. The collet housing 434 is axially slidable along the tool assembly and with respect to the collet body 449 is biased by the biasing spring 444 in the spring housing 446 in an upward direction. The collet housing 432 is initially held in place by a retaining mechanism, such as a shear pin assembly 440 with shear pins 442 attaching the collet housing to the collet body. Alternate retaining mechanisms can be employed such as shear rings, snap rings and collars, locking dogs, etc., as are known in the art.

During use, the collet housing 432, which is preferably a sliding sleeve attached to locking sleeve 463 at 465 as shown, is positioned over the lower tool assembly, such as stinger mover 302, in a latching position, as seen in FIG. 5. The collet tool is lowered until the housing abuts an annular shoulder 310 of the stinger assembly and the collet dogs latch into the collet trap. Weight-down is placed on the upper tool assembly. The shear pins are sheared, and collet housing 432 moves upward relative to the collet arms 436 until the collet dogs 438 are secured in the collet trap 304 by the collet retainer 450 of the collet housing 432. The collet dogs 438 engage the collet trap 304 of the lower tool assembly. The collet assembly and upper tool assembly are then in a latched position with respect to the lower tool assembly, as can be seen in FIG. 6.

The collet and collet trap connection assembly is exemplary; other collet designs can be used. Further, other cooperating connectors can be utilized on the upper and lower tool assemblies, such as threads, ratchets, latches, quick connects, push-to-connect fittings, etc., as are known in the art.

The upper tool assembly further includes a locking subassembly 460 having an upper locking element 462 and a lower locking element 463 which "lock" together to further insure the upper and lower tool assemblies remain connected until selectively disconnected.

In a preferred embodiment, the upper locking element 462 is a rotatable sleeve mounted on the tool assembly, such as around tubular body 421. The upper locking element or sleeve 462 is attached to the sealing sub 406 at attachment 429 but is free to rotate with respect to the sealing sub. Seals 466 can be provided as shown. The upper sleeve is movably attached to the sealing sub at a rotational joint, such as pin 426 and slot or groove 428. The pin limits the rotation of the sleeve. At the lower end of the sleeve 462 is an upper mating assembly 468 having at least one upper mating member 470 which cooperates with corresponding lower mating assembly 472 and at least one lower mating member 474.

The lower locking element 463, in a preferred embodiment, is an axially movable sleeve mounted on the tool assembly, for example, about tubular body 421. The lower sleeve 463 is biased upward by biasing spring 444 as explained elsewhere herein. The spring 444 is useful to move the sleeve 463 and collet housing 434. The spring 444 is also useful to pressure or force the lower sleeve 463 upwards toward the upper sleeve 462. Alternately, a separate biasing element can be used. Alternate details of the locking elements and mating members will be explained below. As used herein, a biasing spring can be a spring or other biasing element, as is known in the art.

The tool assembly further includes a slidable piston assembly 480. The piston assembly includes, preferably, a slidable piston element 482, shown as an annular piston positioned in an annular piston housing 484 is defined between the upper sleeve 462 and the tubular body 421. The piston element 482 is preferably keyed to the body 421 or similar. The piston assembly can take other configurations and is for translating differential pressure across zones into axial (or linear) movement of an element. The piston need not be annular; it can be a stepped piston assembly, positioned centrally, etc. The piston element preferably includes one or more seals 486 for sealing against fluid flow between the piston and piston housing surfaces. In a preferred embodiment there are multiple annular seals.

The piston element is biased in a first direction, preferably downward as shown, by a biasing spring 488 positioned in a spring housing 490 defined, in the preferred embodiment, between the sleeve interior surface, the mandrel exterior surface and at opposite ends closed by the piston element and a shoulder of the sealing sub. The biasing spring 488 maintains the piston element in a first position, preferably a down position as shown, unless a selected differential pressure is applied across the piston from below, namely, from a higher pressure in the first pressure zone 530. The biasing element is of a selected biasing force to allow movement of the piston at a selected pressure differential.

Figure 7:
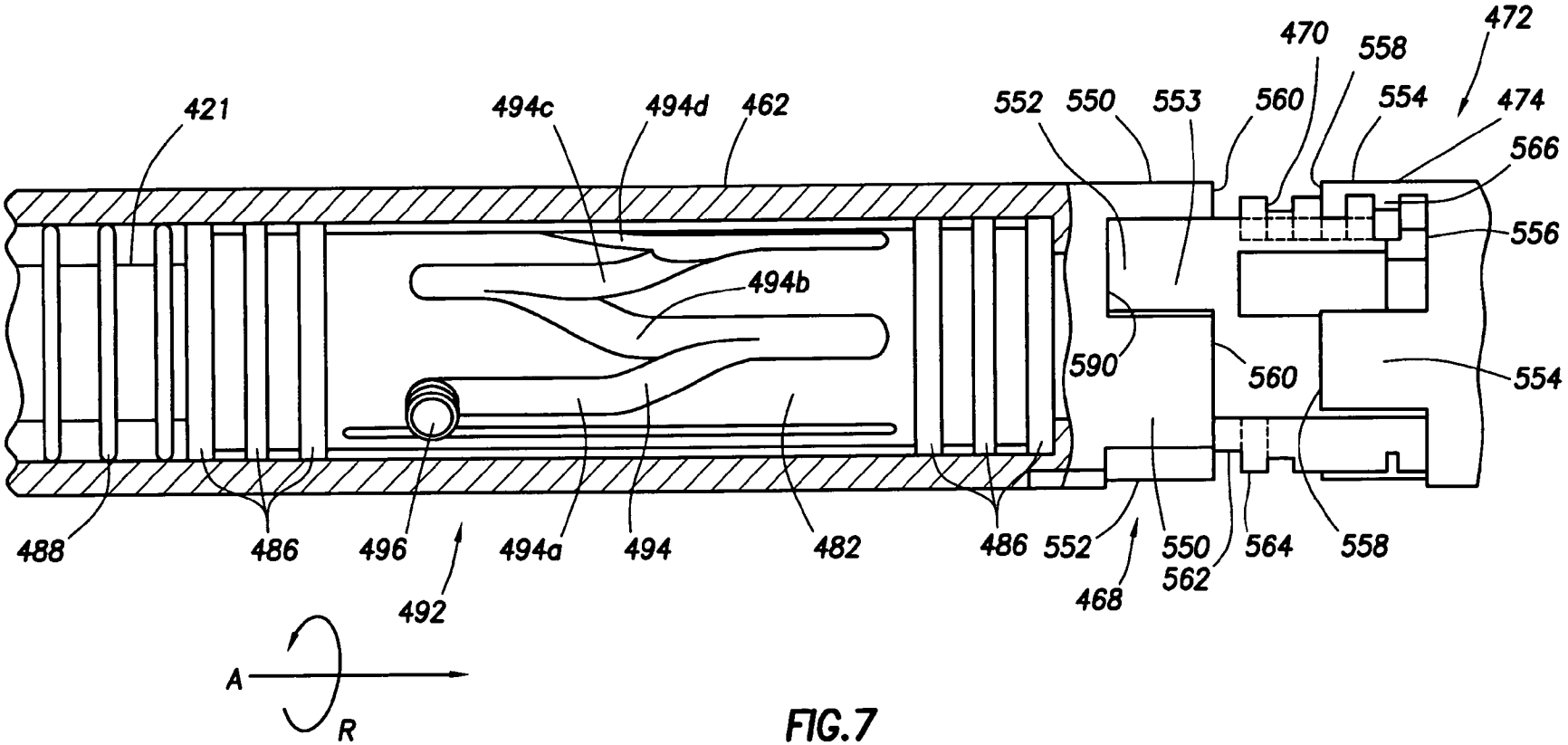
FIG. 7 is a schematic view, in partial cross-section, of translational and locking assemblies according to an aspect of the invention.

FIG. 7 is a schematic view in partial cross-section of a translational assembly according to an aspect of the invention. A translational assembly 492 translates linear motion of the piston assembly into rotational motion of the upper locking sleeve 462. In a preferred embodiment, the piston element 482 has a grooved track 494 defined on its outer surface. One or more ball followers 496 (shown not in cross-section) are mounted to the upper sleeve 462 (shown in cross-section) and extend into the groove 494 such that axial movement of the piston results in rotational movement of the sleeve.

The architecture of the track 494 determines the degree of rotation of the sleeve in response to a single stroke of the piston element. The track can be designed, as shown, to require multiple strokes of the piston element to rotate the sleeve the desired degree of rotation. The track can take any of a number of shapes, as is known in the art, to cause desired rotation of the sleeve in response to movement of the piston element. Further, the track can be defined on the interior surface of the sleeve with the ball followers extending from the piston exterior surface. The "ball followers" are preferable although other followers can be employed. For reference, the grooved track can be divided into a first course 494*a*, a second course 494*b*, etc., as indicated, for sections of the track corresponding to each sequential rotation in response to reciprocating motion of the piston element. Other track-and-follower assemblies are possible as well. For example, the grooved track can instead be a slotted track, having a slot extending through a tubular member, with one or more followers extending into or through the slot. Similarly, the track and follower or translational assembly can take other forms as are known in the art.

The upper mating assembly 468 preferably includes alternating longitudinally extending teeth 550 and notches 552. In a preferred embodiment, the teeth 550 and notches 552 are defined by recessed surfaces in the sleeve exterior surface. The upper mating assembly 468 cooperates with the lower mating assembly 472 on the lower sleeve 463. The lower sleeve has longitudinally extending teeth 554 and notches 556. In the preferred embodiment shown, the teeth 554 of the lower mating assembly extend from the lower sleeve and have an exterior surface co-extensive with the sleeve exterior surface. The notches are "gaps" between the teeth. Alternate designs of the teeth and notches are possible, including recessed notches on either or both sleeves, teeth and notches which are not "square" as shown but have cooperating angled surfaces, or thread portions, etc.

FIG. 7 shows the assembly in the run-in position, prior to shearing of the shear pins. When the pins are sheared, the lower sleeve 463, in response to the force of the biasing spring 444, shifts upward towards upper sleeve 462. More specifically, the upper surfaces 558 of the teeth 554 of the lower sleeve bear on the lower surfaces 560 of the teeth 550 of the upper sleeve. Once the lower sleeve is translated axially upwardly, the lower and upper mating assemblies are aligned in a locking position. Rotational movement of the upper locking element engages and locks the mating assemblies.

The upper mating assembly 468 also preferably has, on the exterior surface of a recessed neck 562, at least one thread 564 which cooperates with corresponding threads 566 defined on the interior surface of teeth 554 of the lower mating assembly. The threads are shown as acme threads and not spiraled. The threads are broken; that is, they do not extend around the entire circumference of the neck 562. Alternate arrangements can be used.

As the piston element moves in response to a pressure differential across it, as shown by arrow A in FIG. 7, the upper sleeve is rotated in the direction indicated by arrow R. In the preferred embodiment shown, a single stroke of the piston, for example upward in response to a higher pressure in the first pressure zone 530, rotates the sleeve a through a selected arc or degree of rotation, preferably one-half of the necessary rotation to rotate the upper and lower cooperating threads into engagement with one another. A second stroke, in the opposite direction in response to a higher pressure in the second pressure zone 540, continues the rotation of the sleeve and aligns the mating members.

Figure 8:
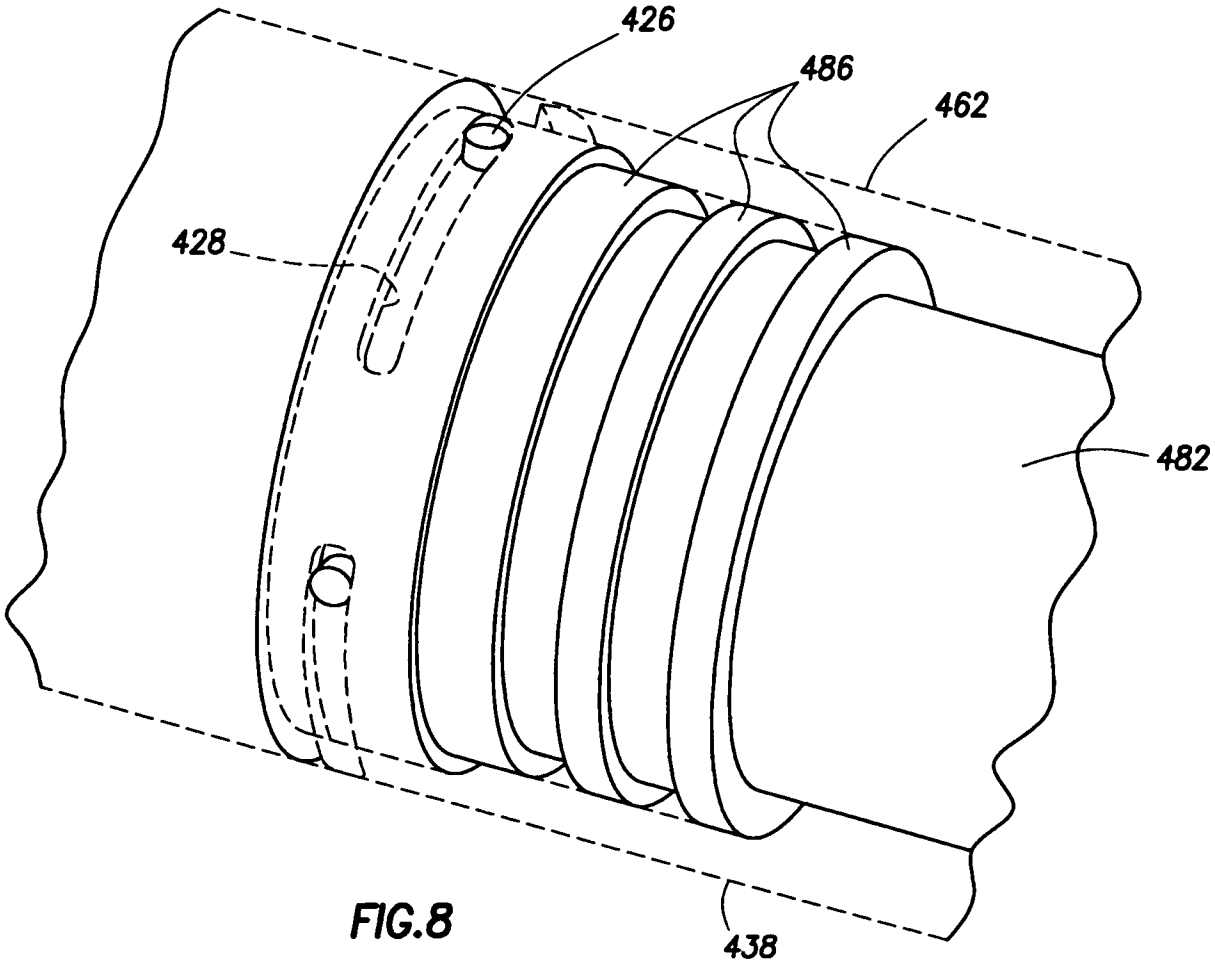
FIG. 8 is a detail perspective view of the rotational joint between subassemblies of the upper tool assembly according to an aspect of the invention.

FIG. 8 is a detail perspective view of the rotational joint between subassemblies of the upper tool assembly according to an aspect of the invention. Ultimate rotational movement of the upper sleeve 462 is preferably limited by the cooperation of the rotational joint members, such as rotation limiters 426 (shown as pins) and rotational guide 428 (shown as a slot).

Figure 9:
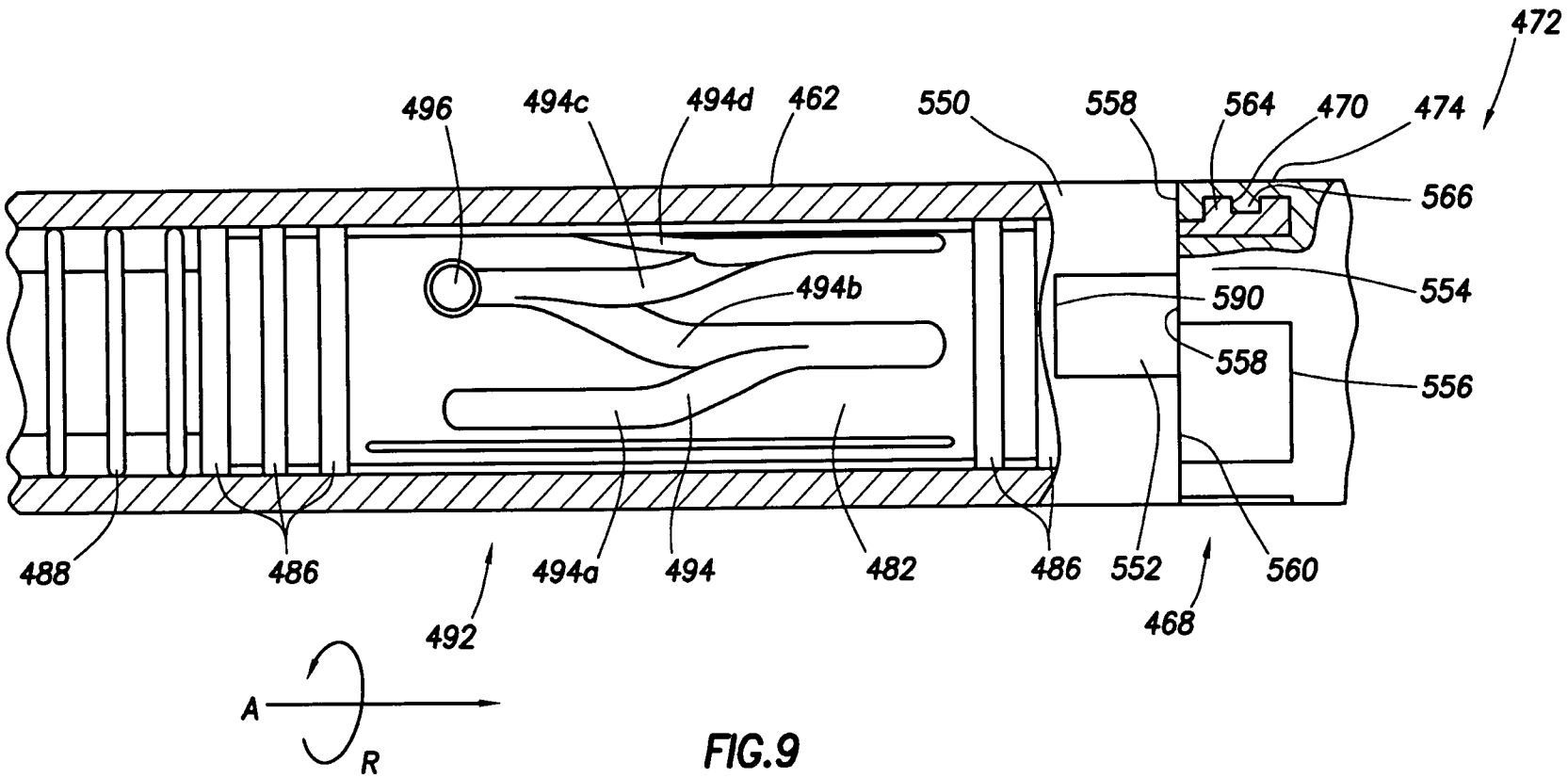
FIG. 9 is a schematic view of the assemblies of FIG. 7 in a locked position according to an embodiment of the invention.

FIG. 9 is a schematic view of the assemblies of FIG. 7 in a locked position according to an embodiment of the invention. The lower sleeve 463 has moved upward towards and into contact with the upper sleeve 462 in response to the weight-down procedure and shearing of the shear pins. The strokes (or a cycle of two strokes) of the piston are then employed to rotate the upper sleeve and mating assembly. The piston element 482 has been stroked upward and downward relative to the upper sleeve in response to alternating pressure differentials across the pressure zones and the piston assembly. The follower 496 has followed along track 494, specifically track courses 494*a* and 494*b*. With the cooperating threads 564 and 566 now aligned and engaged, the upper and lower mating assemblies 468 and 472 (and upper and lower locking elements 462 and 463), are in a locked position. The upper and lower tool assemblies are ready to be lowered into the wellbore. The ram assemblies are opened and the tools lowered into the wellbore according to methods known in the art.

Figure 10:
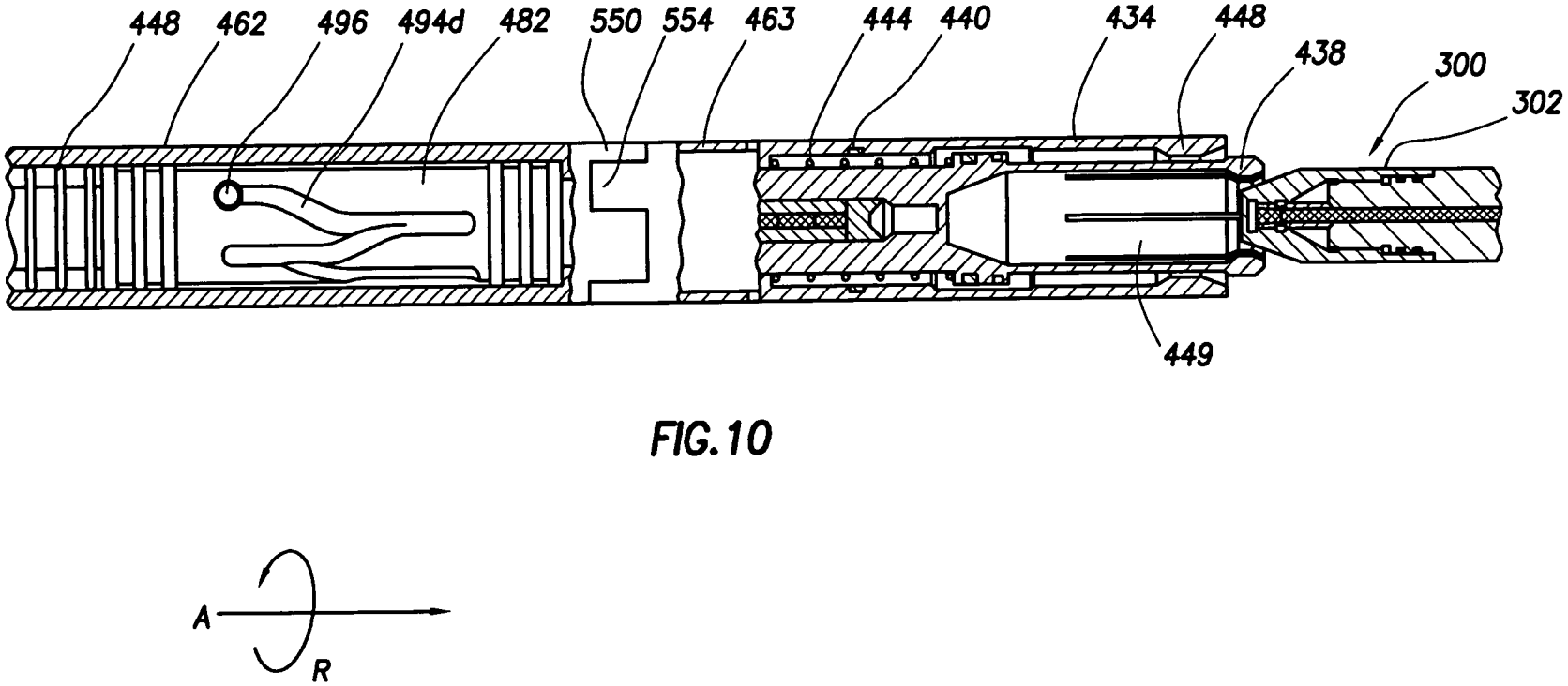
FIG. 10 is a schematic view of the assemblies of FIG. 7, with the locking assemblies in an unlocked position, the connection assembly in an unlatched position, and the tools in a released position.

FIG. 10 is a schematic view of the assemblies of FIGS. 7 and 9, with the locking assemblies in an unlocked position and the connection assembly in an unlatched and unlocked, or released position.

Upon pull out of hole, the rams are again sealed about the sealing surfaces of the lower tool assembly and the sealing sub of the upper tool assembly. A differential pressure applied across the piston assembly again moves the piston element axially, which in turn causes the upper mating assembly to rotate. Further strokes of the piston continue to rotate the sleeve until the cooperating threads of the upper and lower locking elements are disengaged. With the teeth 554 of the lower mating assembly now aligned with the notches 552 of the upper mating assembly, and the teeth 550 of the upper assembly aligned with the notches 556 of the lower assembly, the biasing spring 444 forces the lower sleeve 463 axially upward until the upper surfaces 558 of the teeth 554 seat against the upper surfaces 590 of the notches 552. The axial movement of the lower sleeve 463 also axially moves the collet housing 434, releasing the collet dogs 438 from the collet trap 304. The upper and lower tool assemblies are now in the released position. The upper tool assembly can now be pulled from the work string.

The differential pressure across the piston assembly is applied by changing the pressures in the first and/or second pressure zones. The pressures can be raised (such as by pumping fluid into the zone) or lowered (such as by bleeding off pressure from a zone) to move the piston element. The pressure in the zones can be controlled as is known in the art using pressure ports in a BOP stack, a lubricator assembly, or similar. For example, the pressure in the second zone can be increased or decreased by manipulation of fluid pressure through the pressure ports in the lubricator assembly. Similarly, the pressure in the first pressure zone can be controlled through pressure ports in the BOP. The lubricator and BOP assemblies are exemplary.

In an exemplary method, during connection of the upper and lower tool assemblies, the lower rams are sealed around the stinger assembly and the upper tool assembly is lowered using a lubricator assembly. The upper rams are sealed about the sealing sub. The upper tool assembly is lowered into position over the stinger of the lower tool assembly and the collets latch in the collet trap. Weight down on the string shears the shear pins as described above, and the axially movable lower sleeve is moved upward by the biasing element into a locking position with respect to the upper sleeve. At the same time, the collet arms at the lower end of the upper tool are constrained by the collet housing due to its upward movement. The collets latch in the cooperating collet trap in, the lower tool assembly. Preferably, the upper and lower mating assemblies abut one another, such as at opposing teeth. The mating assemblies are now in a locking position. To lock the mating assemblies, a pressure differential is applied across the piston assembly. For example, the pressure in the second pressure zone can be raised through lubricator pressure ports or the pressure in the first pressure zone can be lowered through the BOP pressure ports. In response to the pressure differential, communicated alternately to the lower end and upper end of the piston, the piston moves axially. The biasing spring 488 can be used to regulate the necessary pressure differential and to maintain the piston in a selected position when the pressure across the piston is balanced. The axial movement of the piston element is translated to rotational movement of the upper mating assembly. Multiple strokes can be used to complete rotation to a locked position, such that the lower mating assembly is mates with the upper mating assembly. The reciprocal motion of the piston is caused by alternating the pressure differential across the piston element (and the pressure zones). The piston is again moved axially a selected number of strokes and the upper mating assembly rotates in response. The rotational movement engages mating threads on the upper and lower mating assemblies. The tools are now connected and in condition for running into the hole. The tools are then run-in, using methods known in the art.

After pull out of hole, the tool assemblies are disconnected. The sealing rams are engaged with the upper and lower tools. A pressure differential is applied across the piston assembly, thereby moving the piston element and rotating the upper mating assembly. One or more strokes of the piston rotate the upper and lower mating assemblies until the mating threads are disengaged. The biasing spring 444 then forces the lower mating assembly upward until the teeth of the lower assembly seat against the notches 590 of the upper assembly. The axial movement of the lower mating assembly and collet housing pulls the housing clear of the collet dogs which are then free to pull out of the collet trap on the lower tool. The tool assemblies are now disconnected. The upper tool can then be pulled.

Additional embodiments are presented as well. For example, in use, the pressure differential can be applied in either direction first, a biasing element on the piston can be used or not, the rotational subassemblies can be rotated only upon movement of the piston in a single direction (with reciprocal piston movement not causing rotation), multiple strokes or cycles can be required to effect rotation, the degree of rotation for aligning, locking, unlocking, etc., can be selected, the rotational elements can be rotated in the opposite direction for locking and unlocking, the differential pressure can be applied before or after pressure ups and downs for other purposes (equalization, bleed-off of wellhead pressure, etc.), the differential pressure effective to move the piston can be selected (for example, in a range that will not actuate other tool subassemblies), etc. The angular displacement of rotational elements per stroke or cycle can be tailored to meet displacement requirements.

Further, the tool assemblies can take the form of additional embodiments. The locking assemblies and methods described herein can be used with or without the collet and collet trap attachment device as shown. In one embodiment, the upper and lower tool assemblies include another known attachment device in place of the collet assembly. The attachment device can be operated by weight-down on the work string for connection, by a threaded attachment, by a rotationally activated attachment (such as by rotating the upper tool assembly relative to the lower tool assembly), etc. Further, the locking and translational assemblies can be positioned in the second tool assembly rather than the first tool assembly, as will be understood by those of skill in the art. In such a case, the positioning of the rams would be designed to correspond to above and below the translational (piston) assembly. The connection subassembly would likely be positioned at the upper end of the lower tool, etc. In another embodiment; the upper and lower mating assemblies, and upper and lower sleeves, act as the connector between the upper and lower tools. That is, the piston and rotational sleeve assembly can be on one tool, with the opposing mating assembly on the other tool.

Figure 11:
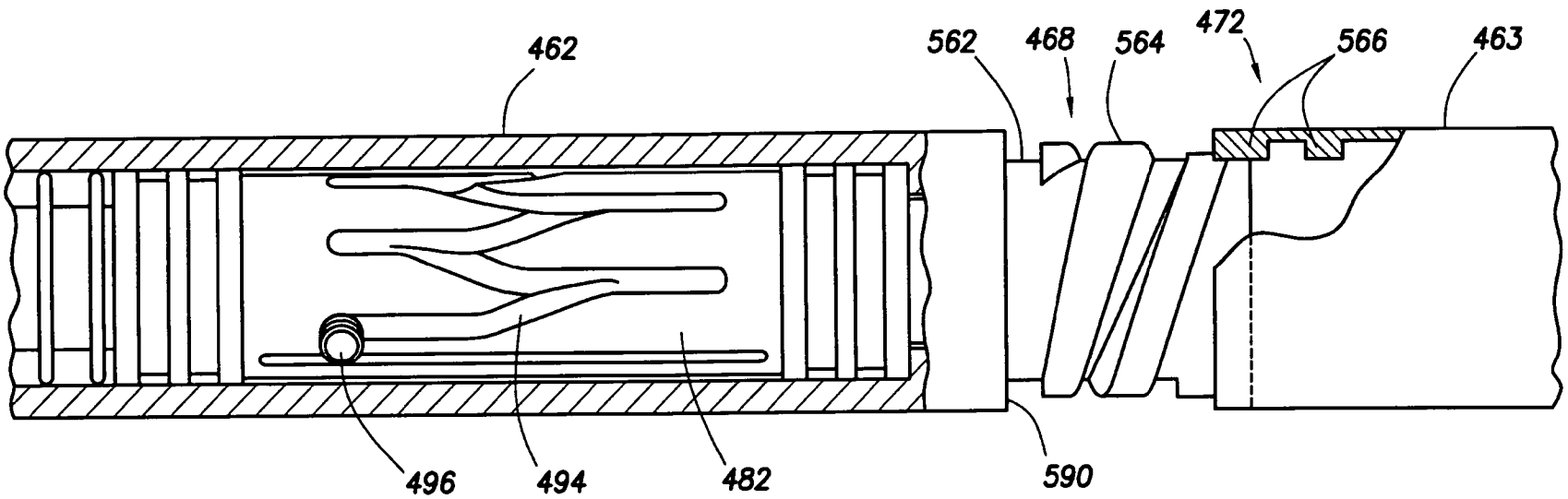
FIG. 11 is a detail schematic view of an alternative embodiment of the locking assembly according to an aspect of the invention.

FIG. 11 is a detail schematic view of an alternative embodiment of the locking assembly according to an aspect of the invention. Details of operation of the alternative embodiment are similar to those described above and so will not be presented again. In this embodiment, the cooperating thread 564 of the upper mating assembly 468 is an acme, spiral thread. The cooperating threads 566 of the lower mating assembly 472 are broken or partial threads, as shown. The lower locking element 463 is axially moved upward into contact with the upper locking element 462 as described above. In the preferred embodiment, the threads 566 on the lower mating member 472 move into and abut the threads 564 on the neck 562 of the upper mating member.

The piston assembly is actuated by differential pressure and in response the upper mating member rotates (once or more in response to one or more piston strokes), locking the mating members axially together by engagement of the cooperating threads. The thread pitch can be tailored to optimize tooth engagement. The thread count on the upper thread can be selected to allow for rotational displacement requirements and desired stroke count. To unlock the subassemblies after pull out of hole, the piston is again displaced in response to differential pressure and the upper locking element again rotates to unlock the sleeves. In one embodiment, the axial movement of the piston element causes a rotation of the upper sleeve in the opposite direction. The track 494 can be designed such that the follower 496 is moved to track courses which force the follower and sleeve to move rotationally in the opposite direction of the track courses showing in the view in FIG. 11. Alternately, the upper sleeve can be rotated until the lower sleeve is moved upward a great enough distance to unlatch or release the connector assembly 432. That is, the lower sleeve is pulled upward in response to further rotation of the upper sleeve until the collet retainer is pulled axially off the ends of the collet arms 436, thereby releasing the collet dogs 438 from the collet trap 304. In yet another embodiment, the lower sleeve can be rotated, thereby upwardly moving the broken threads 566 until they clear the spiral thread 564. The lower sleeve is then moved upwardly on a lengthened neck 562 of the upper mating assembly 468 in response to the biasing spring 444 until it abuts shoulder 590.

Figure 12:
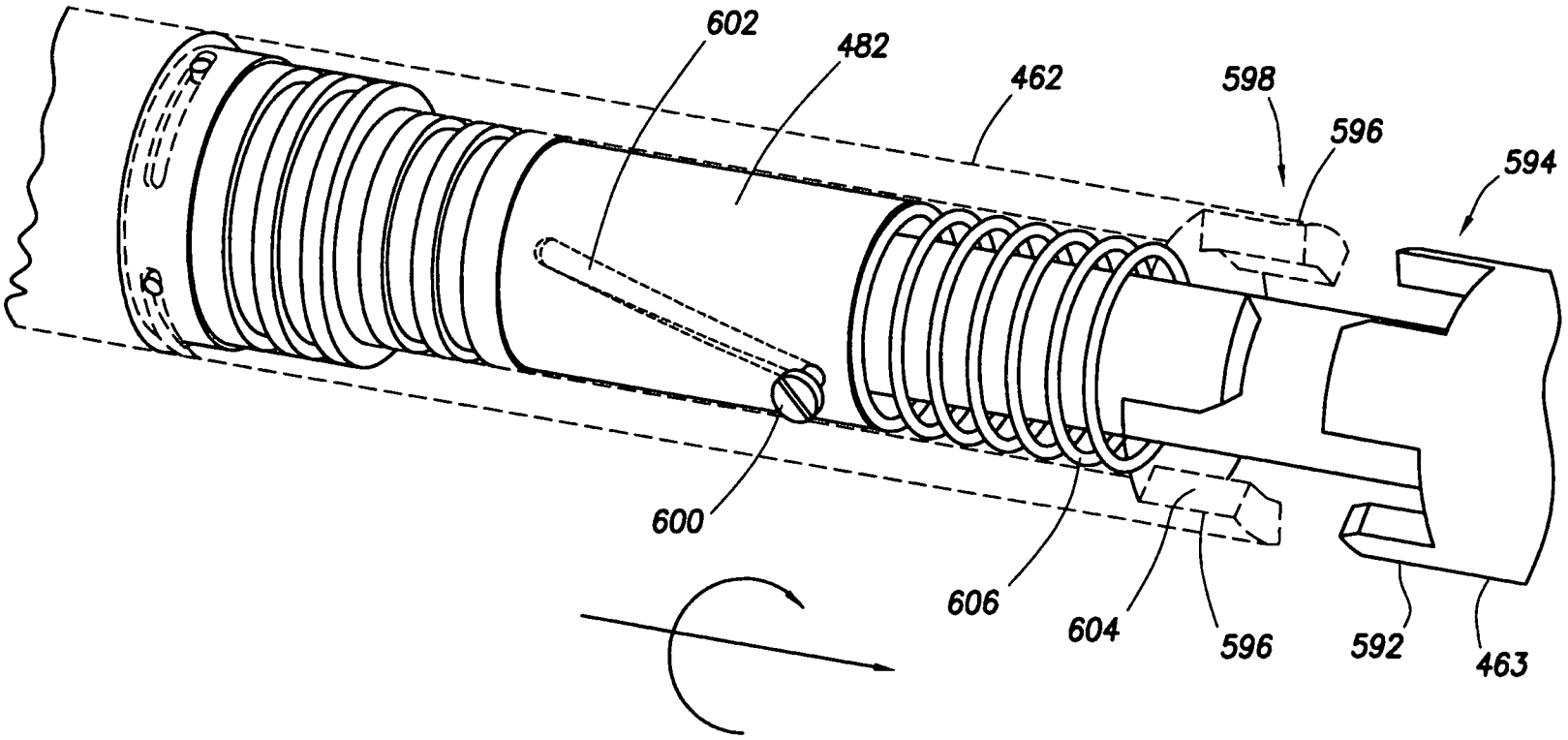
FIG. 12 is a detail schematic of an embodiment of a locking mechanism according to an aspect of the invention.

FIG. 12 is a detail schematic of an embodiment of a locking mechanism according to an aspect of the invention. The upper tool assembly latches and unlatches from the lower, tool assembly using the collet and trap design described above or equivalent. Upon weight down, the shear pins shear and the lower locking element 463 translates upward until the teeth 592 on the mating assembly 594 abut corresponding teeth 596 on the upper mating assembly 598 of the upper locking element 462. To unlock the assembly, the piston element 482 is translated in response to differential pressure across the pressure zones, thereby rotating the upper sleeve. In the embodiment shown, the follower 600 extends from the piston element 482 and cooperates with a groove 602 in the upper sleeve 462. In this case, the groove and piston are designed such that a single stroke of the piston will rotate the upper sleeve sufficiently to align the teeth 592 with corresponding notches 604 on the upper mating assembly. Note that the biasing spring 606, as shown, operates to bias the piston element upward.

Figure 13:
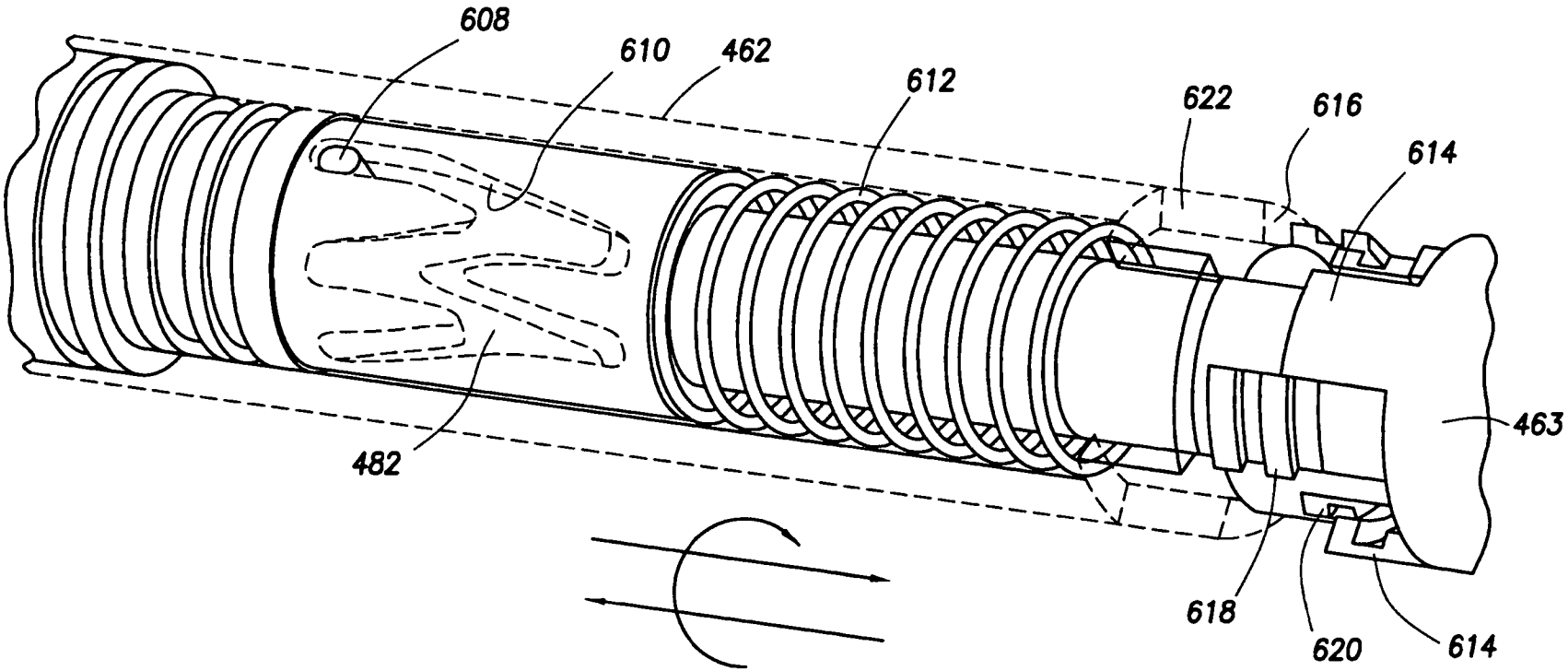
FIG. 13 is a detail schematic of an embodiment of a locking assembly according to one aspect of the invention.

FIG. 13 is a detail schematic of an embodiment of a locking assembly according to one aspect of the invention. The collet and collet trap designs described above are usable with this embodiment of the locking assembly. The weight down and biasing spring methods described above are employed to move the lower locking element 463 into a locking position. A differential pressure is applied across the piston element 482, as explained above. The piston element is keyed to the rotational member, sleeve 462, by follower 608 extending from the piston element and keyed within the guide slots 610 of the upper locking element. Movement of the piston element in response to a differential pressure rotates the upper sleeve. Multiple strokes can be used to accomplish the necessary degree of rotation. Preferably, a pressure-up in one pressure zone moves the piston element rotates the upper locking element 462 fifty percent towards a locked position. A stroke in the opposite direction completes the rotation for movement to a locking position. As the upper locking element rotates, the teeth 614 on the lower locking element engage the cooperating notches 616 on the upper locking element. The lower locking element translates upward in response to a biasing spring (not shown) to seat the teeth 614 in notches 616. The function is similar to a one-way ratchet and the threads can be shaped accordingly. Further movement of the piston rotates the upper locking element until external threads 618 engage internal threads 620, thereby constraining the two locking elements together axially. The unlocking procedure is similar to that described above and will not be repeated in detail. Rotation of the upper locking element results in disengagement of the threads, alignment of the teeth 614 with notch 622 and the lower locking element translates upward under the force of the biasing spring. This translation shifts the collet locking sleeve forward past the collet dogs, releasing the upper and lower tool assemblies.

Figure 14:
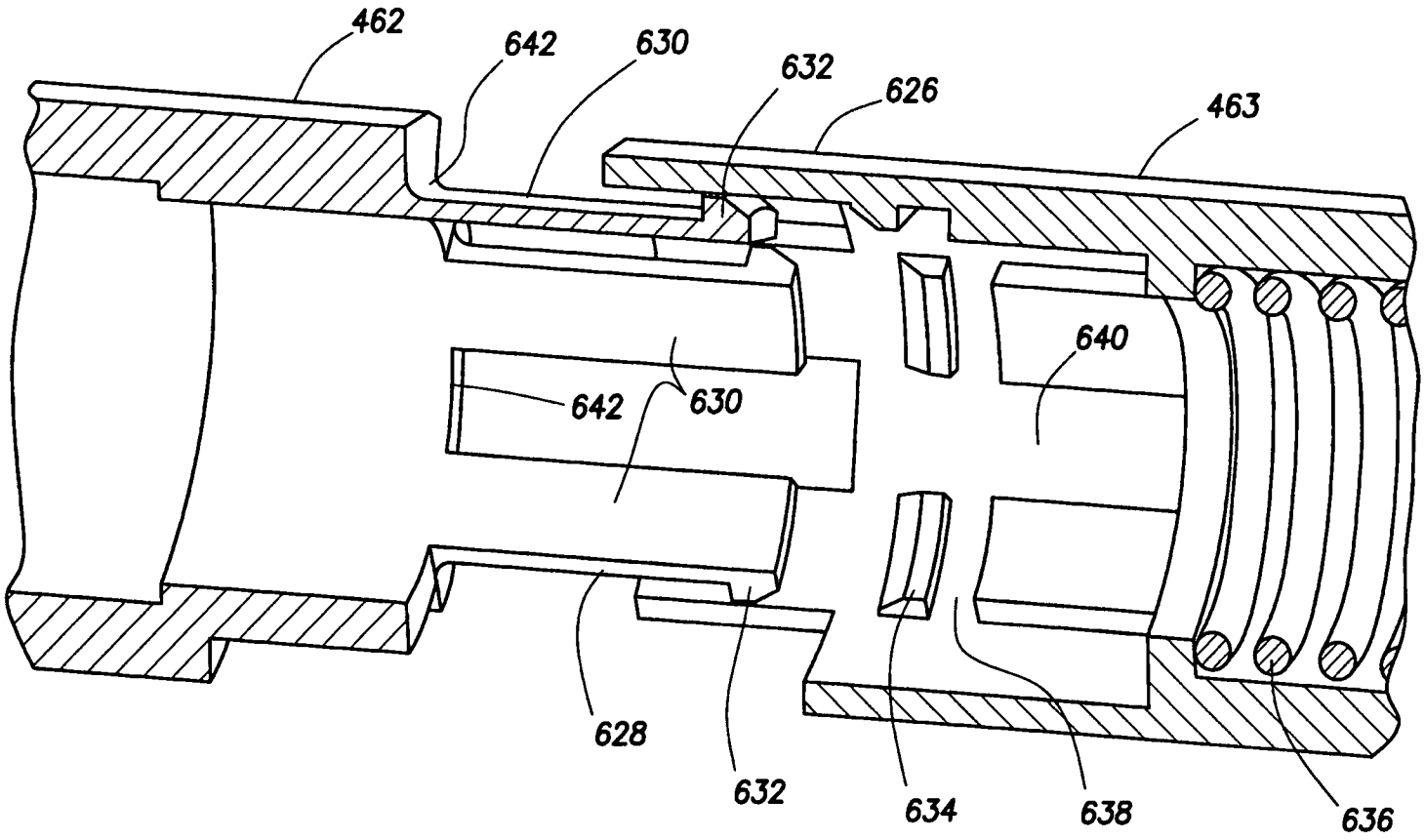
FIG. 14 is a detail schematic in cross-section of an embodiment of a locking assembly according to one aspect of the invention.

FIG. 14 is a detail schematic in cross-section of an embodiment of a locking assembly according to one aspect of the invention. This embodiment will not be described in detail given the above descriptions. The lower locking element 463 has lower mating members 626 extending therefrom. The upper locking element 462 has upper mating members 628 extending therefrom, namely, flexure elements 630. The flexure elements each have dogs 632 extending radially inwardly therefrom which cooperate with locking dogs 634 extending radially from the interior surface of the lower locking element. The dogs 632 and 634 seat against one another when the lower locking element is moved upwardly, such as in response to the biasing spring 636 activated by weight-down on the tool assembly and shearing of shear pins. The flexure elements deflect or flex as the dogs pass one another. The upper dogs. 632 seat into recess 638, locking the two elements together. Unlocking is accomplished similarly to the methods described above. Pressure differential moves a piston element which rotates the upper locking element. When the upper flexure elements 630 rotate into alignment with recesses 640 defined on the interior surface of the lower locking element, the lower locking element moves upward under the force of the biasing spring until the lower mating members abut the upper mating members at shoulder 642. This embodiment functions as a ratchet during locking.

In preferred embodiments of the upper tool assembly, a pressure equalization assembly is provided, namely through ports, such as ports 416, and pressure passageways, such as passageway 418, interior to the tool assembly for equalizing pressure on the exterior of the tool assembly (in the wellbore) and inside the tool assembly during run-in, operation downhole and pull-out of hole. Pressure can also be communicated into the tool below the piston element by appropriate ports and passageways in the tool assembly.

Figure 15:
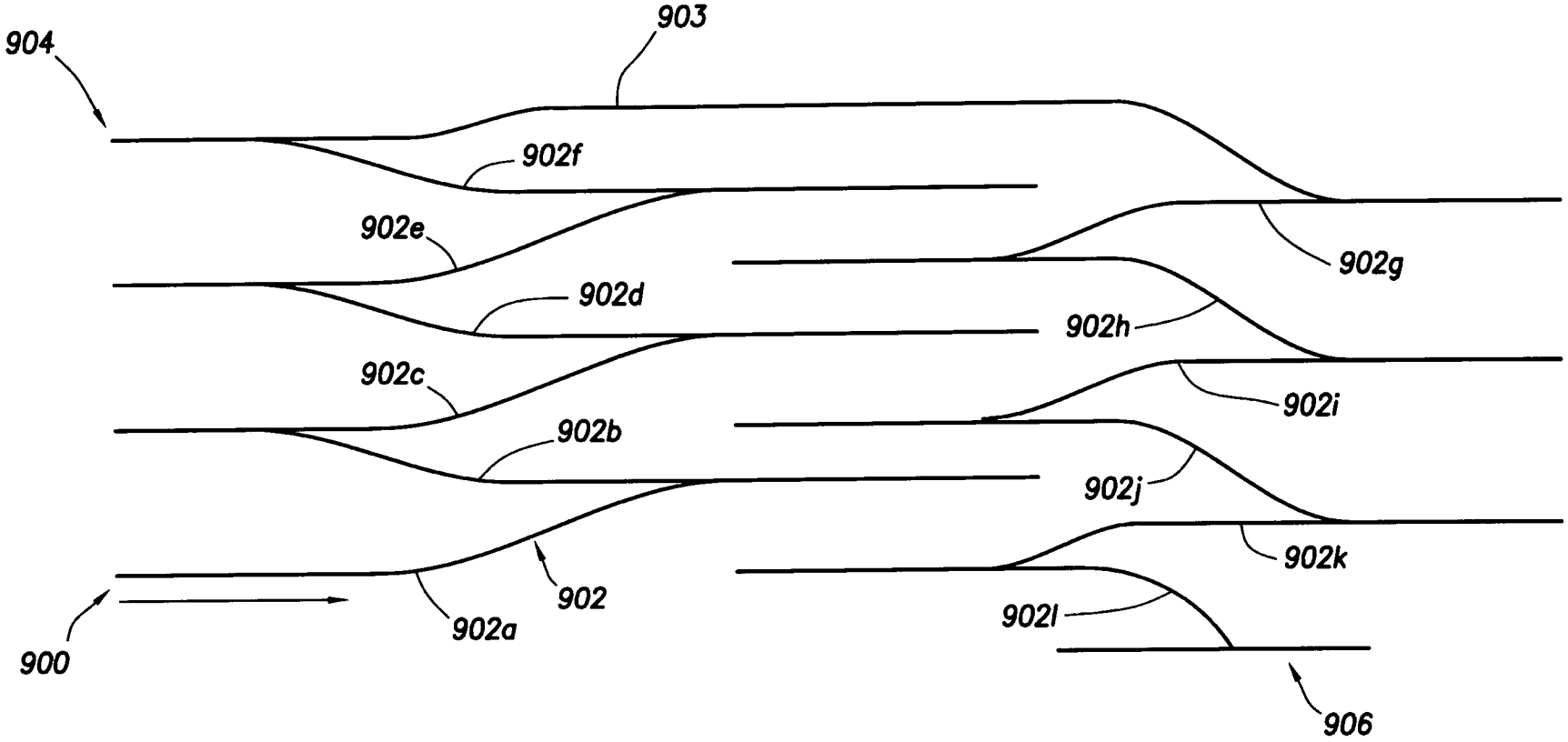
FIG. 15 is a translational groove architecture, unwrapped, according to an aspect of the invention.

FIG. 15 is a translational groove architecture, unwrapped, according to an aspect of the invention. The groove 902 is comprised of courses 902*a*-1 and 903. The follower (not shown) is initially at run-in position 900. Alternating axial movement of the piston causes the follower to move along courses 902*a-f* until the assembly is in a latched position 904. The piston is again moved axially and the follower moves along reversal course 903. Continual piston reciprocation moves the follower along reversed courses 902*g-l* until in an unlocked position 906.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method for connecting and disconnecting tubular sections of a work string, the work string for use in a subterranean wellbore extending through a hydrocarbon bearing zone, the method comprising:

positioning a work string having a plurality of connected tubular sections adjacent an upper and a lower sealing ram, the plurality of tubular sections including a stinger assembly connected below a downhole tool assembly;

sealing wellbore pressure below the downhole tool assembly by sealing the lower sealing ram around the stinger assembly;

sealing the upper sealing ram around the downhole tool assembly thereby creating a first pressure zone between the upper and lower sealing rams and a second pressure zone above the upper sealing ram;

applying a differential pressure across the first and second pressure zones;

moving a piston element slidably mounted in the downhole tool assembly in a first direction in response to the application of the differential pressure;

moving at least one of an upper mating member and lower mating member of the downhole tool assembly relative to the other in response to the movement of the piston element;

disconnecting the downhole tool assembly from the stinger assembly in response to the relative movement of the upper and lower mating members; and pulling the downhole tool assembly from its position adjacent the upper sealing ram to the surface.

2. A method as in claim 1 further comprising releasing the upper sealing ram from the downhole tool prior to the step of pulling the downhole tool assembly.

3. A method as in claim 2 wherein the step of applying a pressure differential further comprises the step of increasing pressure in the second pressure zone.

4. A method as in claim 3 further comprising the step of reducing pressure in the first pressure zone prior to increasing the pressure in the second pressure zone.

5. A method as in claim 1 wherein the upper mating member is rotated.

6. A method as in claim 1 wherein the upper and lower mating members move longitudinally with respect to one another in response to movement of the piston element.

7. A method as in claim 6, wherein one of the mating members is spring biased, the spring bias causing the longitudinal movement.

8. A method as in claim 7, wherein the upper and lower mating members comprise corresponding teeth and notches, and wherein the mating members move longitudinally with respect to one another when the teeth align with the notches.

9. A method as in claim 1, wherein the upper and lower mating members have cooperating threads, and wherein rotational movement of the at least one mating member disengages the cooperating threads.

10. A method as in claim 1, wherein the step of disconnecting further comprises the step of releasing a connection between the downhole tool assembly and the stinger assembly.

11. A method as in claim 10, wherein the step of releasing a connection further comprises releasing a collet of the downhole tool assembly from a cooperating collet trap of the stinger assembly.

12. A method as in claim 1, further comprising the steps of applying alternating pressure differentials across the first and second pressure zones.

13. A method as in claim 12, wherein repeated movements of the piston element in response to repeated applications of pressure differentials incrementally moves at least one mating member.

14. A method as in claim 1 wherein the step of moving a mating member in response to movement of the piston element further comprises moving a follower along a surface groove.

15. A method as in claim 1, further comprising the step of connecting the downhole tool assembly to the stinger assembly prior to the steps in claim 1.

16. A method as in claim 15, wherein the step of connecting the downhole tool assembly and the stinger assembly further comprises the steps of sealing the upper sealing ram about the downhole tool assembly and sealing the lower sealing ram about the stinger assembly, thereby creating a first pressure zone between the upper and lower sealing rams and a second pressure zone above the upper sealing ram.

17. A method as in claim 16, further comprising applying a pressure differential across the first and second pressure zones.

18. A method as in claim 17, further comprising moving the piston element in response to the application of pressure differential.

19. A method as in claim 18, further comprising moving the upper mating member in response to movement of the piston element.

20. A method as in claim 19, further comprising rotating the upper mating member in relation to a lower mating member, and thereby locking the upper and lower mating members together axially.

* * * * *